US010016027B2

(12) United States Patent
Yoneoka

(10) Patent No.: US 10,016,027 B2
(45) Date of Patent: Jul. 10, 2018

(54) ARTICLE WITH SLIDE FASTENER AND METHOD FOR PRODUCING ARTICLE WITH SLIDE FASTENER

(71) Applicant: YKK Corporation, Tokyo (JP)

(72) Inventor: Morimasa Yoneoka, Toyama (JP)

(73) Assignee: YKK Corporation (JP)

( * ) Notice: Subject to any disclaimer, the term of this patent is extended or adjusted under 35 U.S.C. 154(b) by 427 days.

(21) Appl. No.: 14/764,336

(22) PCT Filed: Jan. 31, 2013

(86) PCT No.: PCT/JP2013/052236
§ 371 (c)(1),
(2) Date: Jul. 29, 2015

(87) PCT Pub. No.: WO2014/118948
PCT Pub. Date: Aug. 7, 2014

(65) Prior Publication Data
US 2015/0374077 A1 Dec. 31, 2015

(51) Int. Cl.
*A44B 19/42* (2006.01)
*A44B 19/02* (2006.01)
(Continued)

(52) U.S. Cl.
CPC ..... *A44B 19/42* (2013.01); *A41H 37/003* (2013.01); *A44B 19/02* (2013.01); *A44B 19/32* (2013.01);
(Continued)

(58) Field of Classification Search
CPC ..... A44B 19/42; A44B 19/02; A44B 19/32; A44B 19/52; A44B 19/62; A44B 19/34; A44B 19/40
See application file for complete search history.

(56) References Cited

U.S. PATENT DOCUMENTS 4,169,421 A 10/1979 Foults
6,427,294 B1 8/2002 Shibaike et al.
(Continued)

FOREIGN PATENT DOCUMENTS

CN 1787757 A 6/2006
CN 202536291 U 11/2012
(Continued)

OTHER PUBLICATIONS

International Search Report, PCT Application No. PCT/JP2013/052236, dated Apr. 23, 2013.
(Continued)

*Primary Examiner* — Robert Sandy
*Assistant Examiner* — Matthew J Sullivan
(74) *Attorney, Agent, or Firm* — Kilpatrick Townsend & Stockton LLP

(57) ABSTRACT

There is provided an article with a slide fastener affixed thereto. Each of a pair of element members has a plurality of single elements made of a synthetic resin and fixedly integrated and connected to at least one flexible connecting string-shaped member at an equal interval. A slider is formed with an element guide path between upper and lower blades. A fastener-attached member forms an opening and closing part of the article. The pair of element members are directly sewn to a first surface of the fastener-attached member by sewing threads. The element members and the fastener-attached member are inserted into the element guide path of the slider.

13 Claims, 13 Drawing Sheets

(51) Int. Cl.

| | |
|---|---|
| ***A44B 19/52*** | (2006.01) |
| ***A44B 19/62*** | (2006.01) |
| ***A41H 37/00*** | (2006.01) |
| ***A44B 19/32*** | (2006.01) |
| *A44B 19/34* | (2006.01) |
| *A41D 13/012* | (2006.01) |

(52) U.S. Cl.
CPC ..... *A44B 19/52* (2013.01); *A44B 19/62* (2013.01); *A41D 13/012* (2013.01); *A44B 19/34* (2013.01)

(56) References Cited

U.S. PATENT DOCUMENTS

| | | | | |
|---|---|---|---|---|
| 9,237,782 | B2 * | 1/2016 | Ren | A44B 19/04 |
| 9,307,810 | B2 * | 4/2016 | Himi | A44B 19/04 |
| 2006/0282995 | A1 * | 12/2006 | Liou | A44B 19/32 24/389 |
| 2013/0174388 | A1 * | 7/2013 | Ren | A44B 19/04 24/427 |
| 2014/0366337 | A1 * | 12/2014 | Chou | A44B 19/24 24/389 |

FOREIGN PATENT DOCUMENTS

| | | | | |
|---|---|---|---|---|
| GB | 1236456 | A | 6/1971 | |
| JP | 53-116944 | A | 10/1978 | |
| JP | S62-299205 | A | 12/1987 | |
| JP | 2000-312604 | A | 11/2000 | |
| TW | 166870 | | 8/1991 | |
| WO | 2009/118846 | A1 | 10/2009 | |
| WO | 2010/032331 | A1 | 3/2010 | |
| WO | 2012/020499 | A1 | 2/2012 | |
| WO | WO-2012042601 | A1 * | 4/2012 | A44B 19/04 |

OTHER PUBLICATIONS

Office Action, Chinese Patent Application No. 201380071882.4, dated Jan. 24, 2017.
Office Action Search Report, Chinese Patent Application No. 201380071882.4, dated Jan. 24, 2017.

* cited by examiner

ARTICLE WITH SLIDE FASTENER AND METHOD FOR PRODUCING ARTICLE WITH SLIDE FASTENER

This application is a national stage application of PCT/JP2013/052236, which is incorporated herein by reference.

TECHNICAL FIELD

The invention relates to an article with a slide fastener affixed thereto of which a plurality of element members having engaging heads at an equal interval is sewed and fixed on an article such as clothes, and a method for producing the article with the slide fastener affixed thereto.

BACKGROUND ART

A slide fastener is generally used as an opening and closing tool of an article such as clothes, daily sundries, industrial materials and the like or an article such as various seats of a vehicle, a train, an airplane and the like. In general, the slide fastener used for an opening and closing part of the various articles has a pair of fastener stringers each of which has an element row, and a slider arranged to be slidable along the element rows.

As the fastener stringer, there are generally known a fastener stringer of which an element row is formed by forming a mono filament made of thermoplastic resin into a coil shape or zigzag shape and sewing continuous fastener elements, which have a plurality of engaging heads continuously coupled into one, to a fastener tape, and a fastener stringer of which an element row is formed by directly injection molding single elements made of a synthetic resin to a string-shaped fastener tape.

Also, for example, International Patent Application Publication No. WO2012/020499 (Patent Document 1) discloses a slide fastener 70 having fastener stringers 71 as shown in FIGS. 18 and 19.

The slide fastener 70 disclosed in Patent Document 1 has a pair of right and left fastener stringers 71 each of which has an element row 72 formed on a fastener tape 73, a slider 80 configured to be slidable along the element rows 72, first end stops 78 arranged at one end portions of the right and left element rows 72 and a second end stop 79 arranged at the other end portions of the right and left element rows 72.

In this case, a front and rear direction indicates a tape length direction of the fastener tape 73. In particular, a direction along which the slider 80 slides to engage the element rows 72 of the slide fastener 70 is referred to as front, and a direction along which the slider slides to disengage the element rows 72 is referred to as rear. Also, a right and left direction indicates a tape width direction of the fastener tape 73. Further, an upward and downward direction indicates a tape front and back direction of the fastener tape 73. In particular, a direction of a side of the fastener tape 73 on which a pull tap 81 of the slider 80 is arranged is referred to as an upward direction and an opposite direction thereto is referred to as a downward direction.

Each of the right and left fastener stringers 71 has the string-shaped fastener tape 73 and a plurality of fastener elements 90 arranged on a first surface of the fastener tape 73. The plurality of fastener elements 90 is sewed to the first surface of the fastener tape 73 by a double chain stitch of two sets of sewing threads (not shown) with being connected to each other by two connecting string-shaped members (for example, connecting threads) 91.

Each fastener element 90 is configured by injection molding the synthetic resin to the two connecting string-shaped members 91. Each fastener element 90 has a body portion 92 fixed to the two connecting string-shaped members 91 and an extension portion 93 extending outwardly (towards the engaging matching fastener stringer 71) in the tape width direction from the body portion 92. The extension portion 93 has a first extension portion 93*a* arranged at a side facing the first surface of the fastener tape 73 and a second extension portion 93*b* arranged at a side exposed to the external and having a different shape from the first extension portion 93*a*.

In this case, an upper surface portion, a front end surface portion and a rear end surface portion of the body portion 92 of the fastener element 90 are formed with two recessed accommodation grooves for accommodating sewing threads to sew the fastener element 90 to the fastener tape 73 so that the recessed accommodation grooves are positioned between the two connecting string-shaped members 91. Also, the first extension portion 93*a* has a neck portion 94 extending in the tape width direction from the body portion 92 and having a narrowed shape and an enlarged engaging head 95 further extending from the neck portion 94. The second extension portion 93*b* has a substantially triangular shape of which a size in the tape length direction (front and rear direction) gradually decreases towards a tip portion thereof, as seen from above.

According to the fastener stringer 71 having the above-described configuration disclosed in Patent Document 1, the two sets of sewing threads to sew the fastener element 90 are accommodated in the recessed accommodation grooves of the fastener element 90 and sew and fix the fastener element 90 to the fastener tape 73. Therefore, the fastener element 90 is securely fixed by the sewing threads and the sewing threads are prevented from being separated from the fastener element 90. For this reason, the fixing strength of the fastener element 90 to the fastener tape 73 is improved.

Also, each fastener element 90 connected by the two connecting string-shaped members 91 is sewn by the double chain stitch of the two sets of sewing threads. Therefore, it is possible to stably attach each fastener element 90 to the fastener tape 73.

Further, according to the fastener stringer of the related art where the fastener elements made of synthetic resin are directly injection-molded to the fastener tape, the fastener elements are usually formed over front and back surfaces of the fastener tape. However, according to the fastener stringer 71 of Patent Document 1, the fastener elements 90 injection-molded and made of synthetic resin are arranged only on one tape surface-side of the fastener tape 73. For this reason, according to Patent Document 1, it is possible to lighten the fastener stringer 71 having the injection molded fastener elements 90 and to increase the flexibility of the fastener tape 73 (particularly, the flexibility in the tape front and back direction).

Also, for example, International Patent Application Publication No. WO2009/118846 discloses a concealed slide fastener having fastener stringers configured by injection molding a synthetic resin to connecting string-shaped members.

According to the general slide fastener (fastener stringer) of the related art, the coil-shaped continuous fastener elements or injection molded single fastener elements are attached to a tape side edge portion (element attachment portion) of the fastener tape.

In contrast, for example, Japanese Patent Application Publication No. Sho 62-299205A (Patent Document 3) discloses that in order to improve an appearance (outward appearance quality) of a coloring and the like of an article (article with a slide fastener affixed thereto) with a slide fastener affixed thereto or to lighten the article, when weaving or knitting a cloth of the article, fastener elements are directly woven and fixed or knitted and fixed to the cloth, so that the fastener elements are directly attached to the cloth of the article without a fastener tape.

When the fastener elements are directly woven or knitted to the cloth of the article, it is possible to reduce the number of operating processes in the production of the article with the slide fastener affixed thereto, as compared to a configuration where after the slide fastener is produced, a fastener tape of the slide fastener is sewn to the cloth of the article to produce an article with a slide fastener affixed thereto. For this reason, it is possible to expect the speed-up of the production line and to save the cost.

Further, since it is possible to weave and fix or to knit and fix the fastener elements to the cloth of the article with an exact attachment pitch, it is possible to smoothly perform the opening and closing operation of the slide fastener (an operating of engaging and disengaging the fastener elements).

PRIOR ART DOCUMENT

Patent Document

Patent Document 1: International Patent Application Publication No. WO2012/020499

Patent Document 2: International Patent Application Publication No. WO2009/118846

Patent Document 3: Japanese Patent Application Publication No. S62-299205A

SUMMARY OF INVENTION

Problems to be Solved by Invention

In recent years, for an article such as clothes, for example, a garment, bags, shoes and the like, it is tried to increase an additional value thereof by improving the properties or imparting various functions, depending on the respective uses. For example, the clothes and bags that are daily used are required to have a reduced weight and improved flexibility.

However, according to the slide fastener of the related art having a pair of right and left fastener stringers such as the slide fastener disclosed in Patent Documents 1 and 2, the fastener tapes, the fastener elements and the slider are necessarily provided as the constitutional components of the slide fastener. Therefore, it is not possible to avoid the increase in the weight of the article with the slide fastener affixed thereto. Also, the fastener tapes (i.e., fastener stringers) having the fastener elements attached thereto are attached to the opening and closing part of the article by the sewing, for example, so that the flexibility of the article is lowered.

In the meantime, as disclosed in Patent Document 3, for example, when producing the article with the slide fastener affixed thereto by directly weaving and affixing or knitting and affixing the fastener elements to the cloth of the article, the fastener tapes, which are the indispensable constitutional components of the slide fastener, are not required, so that it is possible to save the weight of the article with the slide fastener affixed thereto.

However, when directly weaving and fixing or knitting and fixing the fastener elements to the cloth of the article, a high-degree skill is required, so that the facility cost increases and it is necessary to secure a trained expert. Also, since it is necessary to configure the cloth so that the fastener elements are directly woven and fixed or knitted and fixed, there are differences between the cloth to which the fastener elements are to be fixed and the other cloth in terms of the flexibility, thickness, texture and the like.

Also, when directly weaving and fixing or knitting and fixing the fastener elements to the cloth of the article, it is difficult to impart a desired function to the cloth, such as the waterproofness imparted by coating a synthetic resin on the cloth of the article. For this reason, the method disclosed in Patent Document 3 has a demerit in that it is not suitable for the production of an article with the slide fastener affixed thereto enabling a special function such as waterproofness to be imparted to the cloth.

It is therefore an object of the present invention to provide an article with a slide fastener affixed thereto capable of implementing the weight saving and the improvement on the flexibility and being easily produced even when a special function such as waterproofness is imparted to a cloth, and a method of producing the article with the slide fastener affixed thereto.

Means for Solving Problems

In order to achieve the above object, according to the present invention, there is provided an article with a slide fastener affixed thereto. The article includes a pair of element members each of which has a plurality of single elements made of a synthetic resin and fixedly integrated and connected to at least one flexible connecting string-shaped member at an equal interval; a slider formed with an element guide path between upper and lower blades, and a fastener-attached member forming an opening and closing part of the article, wherein the pair of element members are directly sewn to a first surface of the fastener-attached member by sewing threads, and wherein the element members and the fastener-attached member are inserted into the element guide path of the slider.

In the article with a slide fastener affixed thereto of the present invention, preferably, the element member is configured by injection molding the plurality of single elements to the two connecting string-shaped members, each of the single elements has a body portion into which the connecting string-shaped members are inserted and an extension portion extending from the body portion outside of the fastener-attached member, and the extension portion has: a first extension portion which is arranged on a first surface-side which is at the fastener-attached member-side and has a neck portion and an engaging head; and a second extension portion which is arranged on a second surface-side spaced from the fastener-attached member and has a triangular shape in which a size thereof in a tape length direction gradually decreases towards an extending direction.

Also, the element member may be configured by injection molding the plurality of single elements to the two connecting string-shaped members, each of the single elements may have an engaging head and a first leg portion and a second leg portion extending so as to interpose the engaging head therebetween, and the connecting string-shaped members may be respectively inserted into the first leg portion and second leg portion.

In the article with a slide fastener affixed thereto of the present invention, preferably, a reinforcement sheet member is attached to the fastener-attached member, and the element members are sewn to the fastener-attached member by the sewing threads together with the reinforcement sheet member. In this case, the reinforcement sheet member is preferably provided between the element members and the fastener-attached member.

Also, in the article with a slide fastener affixed thereto of the present invention, preferably, waterproof layers made of a synthetic resin are formed or resin film members are bonded on a second surface-side of the fastener-attached member, and when the pair of element members are engaged, the opposing waterproof layers or resin film members are contacted to each other.

Further, in the article with a slide fastener affixed thereto of the present invention, a cloth piece separate from the fastener-attached member is preferably attached, as an end stop of the slider, adjacent to at least one of one end portion and the other end portion of an element row formed by the plurality of single elements.

According to the present invention, there is provided a method of producing an article with a slide fastener affixed thereto, the slide fastener being configured to open and close by sliding of a slider and being attached to a fastener-attached member. The method includes preparing a pair of element members having a plurality of engaging heads arranged at an equal interval; preparing a constitutional part having the element members by sewing the element members to a first surface-side of the fastener-attached member and cutting out the fastener-attached member having the element members sewn thereto into a predetermined shape together with the element members or by cutting out the fastener-attached member into a predetermined shape, cutting the element members to have a predetermined length and sewing the element members to the first surface-side of the fastener-attached member, and assembling the article by using the constitutional part and slidably attaching the slider to an element row configured by the element members.

The method of producing an article with a slide fastener affixed thereto of the present invention preferably further includes attaching a cloth piece separate from the fastener-attached member, as an end stop of the slider, adjacent to at least one of one end portion and the other end portion of the element row of the constitutional part.

Also, the method of producing an article with a slide fastener affixed thereto of the present invention preferably further includes preparing each of the element members by injection molding a plurality of single elements having the engaging heads to at least one flexible connecting string-shaped member.

Further, the method of producing an article with a slide fastener affixed thereto of the present invention preferably further includes cutting the element members at a part of the connecting string-shaped member upon the cutting out of the fastener-attached member or upon the cutting of the element members.

Also, the method of producing an article with a slide fastener affixed thereto of the present invention preferably further includes fixing a reinforcement sheet member to the fastener-attached member, and sewing the element members to the fastener-attached member by a sewing thread together with the reinforcement sheet member. In this case, the method of the present invention particularly preferably further includes providing the reinforcement sheet member between the element members and the fastener-attached member.

Further, the method of producing an article with a slide fastener affixed thereto of the present invention preferably further includes, after sewing the element members to the fastener-attached member, forming waterproof layers made of a synthetic resin on a second surface-side of the fastener-attached member so that the opposing waterproof layers are contacted to each other when the element members are engaged or bonding resin film members on the second surface-side of the fastener-attached member so that the opposing resin film members are contacted to each other when the element members are engaged.

Further, the method of producing an article with a slide fastener affixed thereto of the present invention preferably further includes producing a garment serving as the article with the slide fastener affixed thereto by using the constitutional part for a region in which an opening and closing part of a front body or rear body of the garment is formed.

Advantageous Effects of Invention

The article with a slide fastener affixed thereto provided according to the present invention includes the pair of element members each of which has the plurality of single elements made of a synthetic resin and fixedly integrated and connected to at least one flexible connecting string-shaped member at an equal interval, the slider, and the fastener-attached member forming the opening and closing part of the article. Also, the pair of element members is directly sewn to the first surface of the fastener-attached member by the sewing thread, and the element members and the fastener-attached member are inserted into the element guide path of the slider.

According to the article with a slide fastener affixed thereto of the present invention, since a part of the fastener-attached member can be used as a fastener tape, it is possible to configure the slide fastener without using the fastener tape that is necessarily provided for the slide fastener of the related art. The fastener tape is not required any more, so that it is possible to reduce the weight of the article with the slide fastener affixed thereto and to improve the flexibility. In particular, according to the present invention, since the element members are arranged on only the first surface of the garment cloth, it is possible to increase the flexibility of the part of the garment to which the slide fastener is attached (particularly, the flexibility in the front and back direction of the cloth).

Further, according to the article with a slide fastener affixed thereto of the present invention, since it is possible to directly sew the element members to the cloth of the fastener-attached member to which a desired function such as waterproofness has been imparted by the sewing, for example, it is possible to produce the article with a slide fastener affixed thereto of which the cloth has a special function at low cost, as compared to Patent Document 3.

In the article with a slide fastener affixed thereto of the present invention, the element member is configured by injection molding the plurality of single elements to the two connecting string-shaped members, so that it is possible to simplify a structure of the element member and to stabilize a posture of each single element. For this reason, it is possible to easily and stably sew the element members to the fastener-attached member.

Particularly, in the present invention, each single element of the element member has the body portion into which the connecting string-shaped members are inserted and the extension portion extending from the body portion towards the outward direction of the fastener-attached member, and the extension portion has the first extension portion, which is arranged on the first surface-side becoming the fastener-attached member-side and has the neck portion and the engaging head, and the second extension portion, which is arranged on the second surface-side spaced from the fastener-attached member and has the triangular shape of which a size in the tape length direction gradually decreases towards the extending direction. The element member is configured in this way, so that it is possible to stably directly sew the single elements to the fastener-attached member. Also, it is possible to stably disengage and engage the right and left element rows consisting of the element members by sliding the slider.

Also, in the present invention, the single element has the engaging head and the first leg portion and second leg portion with the engaging head being positioned therebetween, and the connecting string-shaped members are respectively inserted into the first leg portion and second leg portion, so that the element member is configured. The element member is configured in this way, so that it is possible to stably directly sew the single elements to the fastener-attached member. Also, it is possible to stably disengage and engage the right and left element rows consisting of the element members by sliding the slider.

Further, in the article with a slide fastener affixed thereto of the present invention, the reinforcement sheet member is attached to the fastener-attached member. Also, the element members are sewn to the fastener-attached member by the sewing thread together with the reinforcement sheet member. Thereby, when directly sewing the element member to the fastener-attached member, even though the fastener-attached member is formed with holes, through which the sewing thread passes, as a sewing machine needle pierces therethrough, a vicinity of the holes can be reinforced by the reinforcement sheet member. Therefore, it is possible to suppress the damage and the like from being caused in the fastener-attached member, so that it is possible to increase the strength and durability of the article with a slide fastener affixed thereto.

In this case, the reinforcement sheet member is provided between the element members and the fastener-attached member. Thereby, the reinforcement sheet member is not seen well, so that it is possible to suppress the outward appearance quality of the article with a slide fastener affixed thereto from being lowered. Also, the reinforcement sheet member extends and is attached to a more inner area of the cloth than the element member in the fastener width direction. Particularly, the reinforcement sheet member extends and is attached to an area in which a flange portion of the slider is slidingly contacted. Thereby, it is possible to reinforce the cloth, which is the fastener-attached member, over a wide range. Further, it is possible to prevent the flange portion of the slider from being directly sliding-contacted to the cloth or to make it difficult for the flange portion to directly sliding-contact the cloth. For this reason, it is possible to suppress the cloth from being worn due to the friction with the slider.

Also, in the article with a slide fastener affixed thereto of the present invention, the waterproof layers made of a synthetic resin are formed or resin film members are bonded on the second surface of the opening and closing part of the fastener-attached member, and when the pair of element members is engaged, the opposing waterproof layers or resin film members are contacted to each other.

Thereby, even when the element member is sewn to the fastener-attached member having waterproofness by the sewing and the fastener-attached member is formed with the holes through which the sewing thread passes, it is possible to prevent the liquid from being introduced through the holes by the waterproof layers of synthetic resin or the resin film members. Also, when the right and left element rows is engaged, it is possible to suppress the liquid from being introduced through opposing side edges of the fastener-attached member forming the opening and closing part. For this reason, it is possible to provide the article with a slide fastener affixed thereto with the excellent waterproofness.

Further, in the article with a slide fastener affixed thereto of the present invention, the cloth piece separate from the fastener-attached member is attached, as an end stop of the slider, adjacent to at least one of one end portion and the other end portion of the element row formed by the plurality of single elements. Thereby, it is possible to prevent the slider slidably attached to the element row from deviating and separating from the element row.

The method of producing an article with a slide fastener affixed thereto of the present invention includes preparing the pair of element members having the plurality of engaging heads arranged at an equal interval. Then, the method includes sewing the obtained element members to the first surface of the fastener-attached member and cutting out the fastener-attached member having the element members sewn thereto into a predetermined shape together with the element members. Alternatively, the method includes cutting out the fastener-attached member into a predetermined shape, cutting the element members to have a predetermined length and sewing the element members to the first surface of the fastener-attached member. Thereby, a constitutional part having the element members is produced. After that, the article is assembled using the obtained constitutional part and the slider is slidably attached to an element row configured by the element members. Thereby, the article with a slide fastener affixed thereto is produced.

According to the producing method of the present invention, it is possible to stably produce the article with a slide fastener affixed thereto assembled into a predetermined shape by using a plurality of constitutional parts including the constitutional part having the element members. Also, according to the producing method of the present invention, since it is possible to directly sew the element members to the cloth of the fastener-attached member to which a desired function such as waterproofness has been imparted by the sewing, it is possible to easily produce the article with a slide fastener affixed thereto having the function at low cost. According to the article with a slide fastener affixed thereto produced by the above producing method, a part of the fastener-attached member is used as a fastener tape, as described above. Therefore, the article is lightweight and has excellent flexibility.

The producing method of the present invention includes attaching the cloth piece separate from the fastener-attached member, as an end stop of the slider, adjacent to at least one of one end portion and the other end portion of the element row of the constitutional part. Thereby, when configuring the article with a slide fastener affixed thereto, it is possible to prevent the slider slidably attached to the element rows from deviating and separating from the element rows.

Also, the producing method of the present invention includes preparing each of the element members by injection molding the plurality of single elements having the engaging heads to at least one flexible connecting string-shaped member and connecting the single elements by the connecting string-shaped member. Thereby, it is possible to configure the element member by a simply structure and to stably produce the article with a slide fastener affixed thereto having the element members at low cost. Meanwhile, in the producing method of the present invention, as the element member, a continuous element member configured by forming a mono filament into a coil or zigzag shape and having a plurality of engaging heads at an equal interval may be used.

In this case, the producing method of the present invention includes cutting the element members at a part of the connecting string-shaped member upon the cutting out of the fastener-attached member or upon the cutting of the element members. Thereby, when producing the article with a slide fastener affixed thereto, it is possible to effectively and correctly cut the element members.

Also, the producing method of the present invention includes fixing the reinforcement sheet member to the fastener-attached member by bonding or welding, and sewing the element members to the fastener-attached member by a sewing thread together with the reinforcement sheet member. Thereby, since it is possible to reinforce the fastener-attached member by the reinforcement sheet member, the damage and the like are not caused well in the fastener-attached member, so that it is possible to stably produce the article with a slide fastener affixed thereto having excellent strength and durability.

In this case, the producing method of the present invention includes providing the reinforcement sheet member between the element members and the fastener-attached member. Thereby, it is possible to attach the reinforcement sheet member to the fastener-attached member so that it is not seen well. For this reason, it is possible to suppress the deterioration of the outward appearance quality of the article with a slide fastener affixed thereto.

Further, in this case, the reinforcement sheet member extends and is attached to a more inner area of the cloth than the element member in the fastener width direction. Particularly, the reinforcement sheet member extends and is attached to an area of the cloth in which a flange portion of the slider is slidingly contacted. Thereby, it is possible to reinforce the cloth over a wide range. Further, it is possible to prevent the flange portion of the slider from being directly sliding-contacted to the cloth or to make it difficult for the flange portion to directly sliding-contact the cloth. For this reason, it is possible to suppress the cloth from being worn due to the friction with the slider.

Also, the producing method of the present invention includes, after sewing the element members to the fastener-attached member, forming the waterproof layers made of a synthetic resin on the second surface of the fastener-attached member so that the opposing waterproof layers are contacted to each other when the pair of element members are engaged. Alternatively, the producing method of the present invention includes, after sewing the element members to the fastener-attached member, bonding the resin film members on the second surface of the fastener-attached member so that the opposing resin film members are contacted to each other when the element members are engaged.

The waterproof layers or resin film members are formed on the second surface of the fastener-attached member, so that even though the fastener-attached member is formed with holes upon the sewing as a sewing machine needle pierces therethrough, it is possible to prevent the liquid from being introduced through the holes. Also, when the right and left element rows are engaged, it is possible to suppress the liquid from being introduced through a gap between opposing side edges contacting each other of a pair of fastener-attached members. For this reason, it is possible to improve the waterproofness of the article with a slide fastener affixed thereto.

Further, according to the producing method of the present invention, it is possible to appropriately produce a garment serving as the article with the slide fastener affixed thereto by using the constitutional part for a region in which an opening and closing part of a front body or rear body of the garment is formed. Also, it is possible to provide the garment with a slide fastener affixed thereto with a desired function such as waterproofness at low cost. Also, according to the garment produced by the producing method of the present invention, the opening and closing part of the front body or rear body can be opened and closed by the slide fastener and a part of the cloth is used as a fastener tape. Therefore, the garment is lightweight and has excellent flexibility.

EMBODIMENTS OF INVENTION

Hereinafter, preferred illustrative embodiments of the present invention will be described in detail with reference to the drawings. In the meantime, the present invention is not limited to the illustrative embodiments and can be variously changed inasmuch as the changes have substantially the same configuration as the present invention and accomplish the same operational effects.

For example, in the respective illustrative embodiments, a case where an article with a slide fastener affixed thereto is a garment with a slide fastener affixed thereto is described. However, the article with the slide fastener affixed thereto according to the present invention is not limited to the garment (clothes) and includes daily sundries such as shoes and bags, an article such as industrial materials, and various seats of a vehicle, a train, an airplane and the like.

First Illustrative Embodiment

Figure 1:
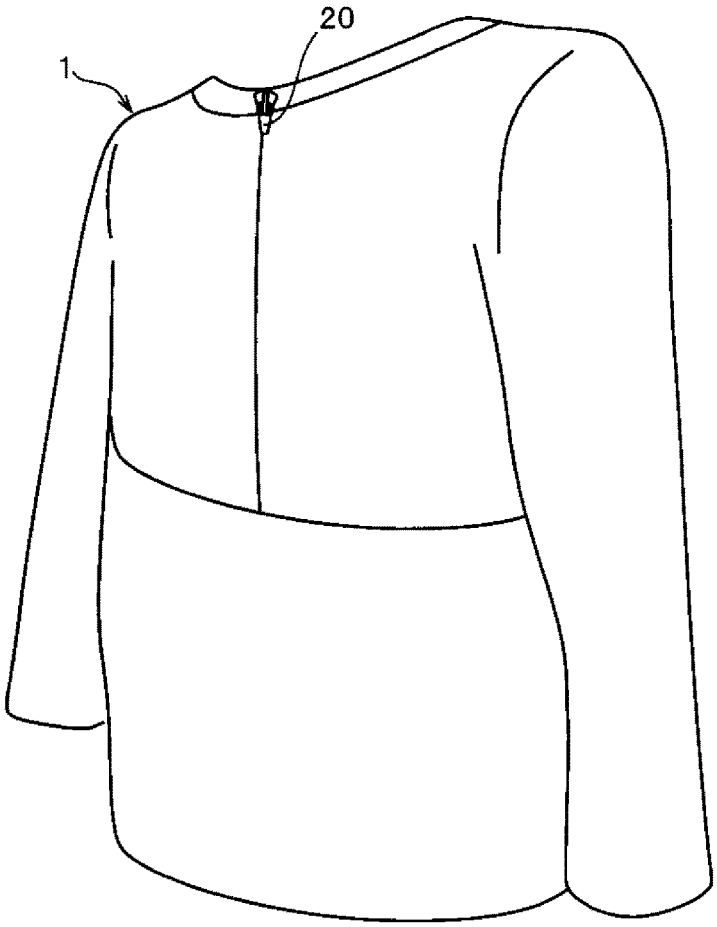
FIG. 1 pictorially illustrates an outward appearance of an article (garment) with a slide fastener affixed thereto according to a first illustrative embodiment of the present invention.
Figure 2:
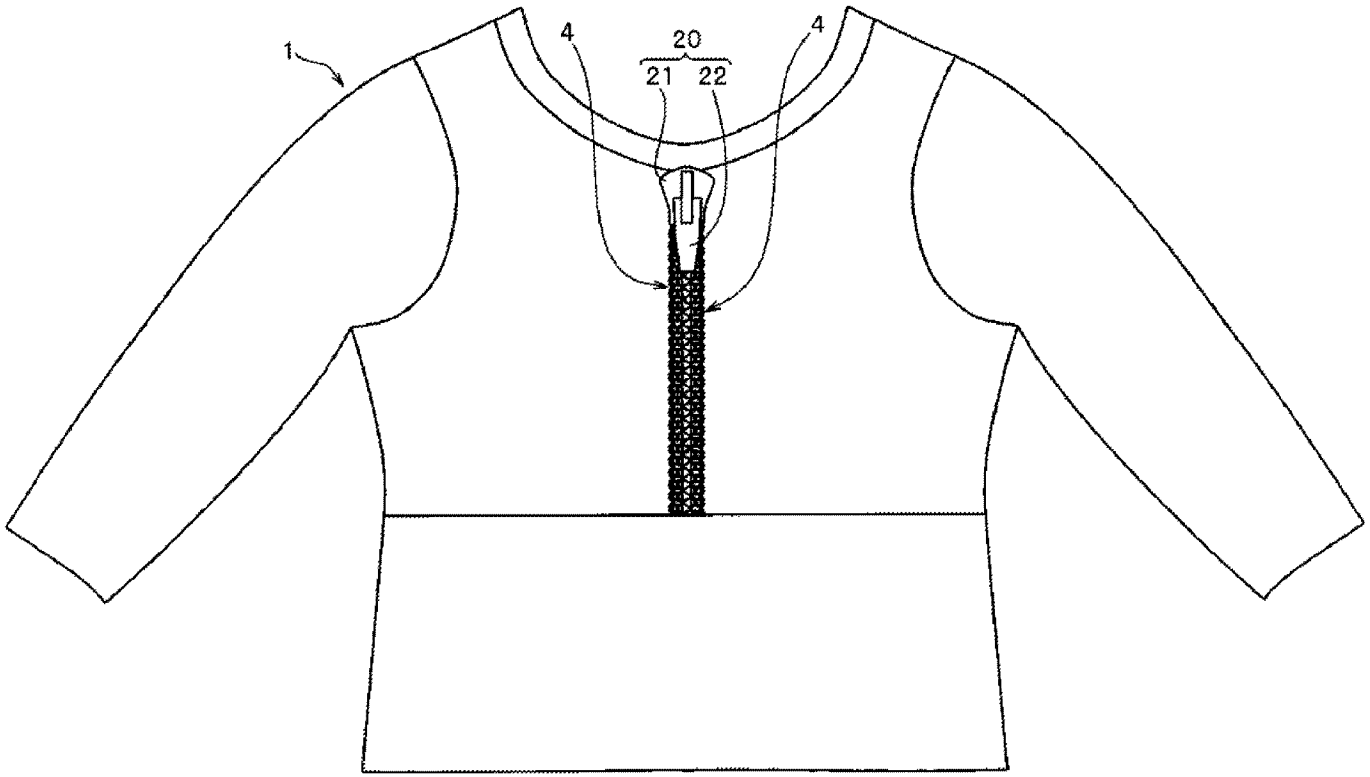
FIG. 2 is a front view of the article with the slide fastener affixed thereto.
Figure 3:
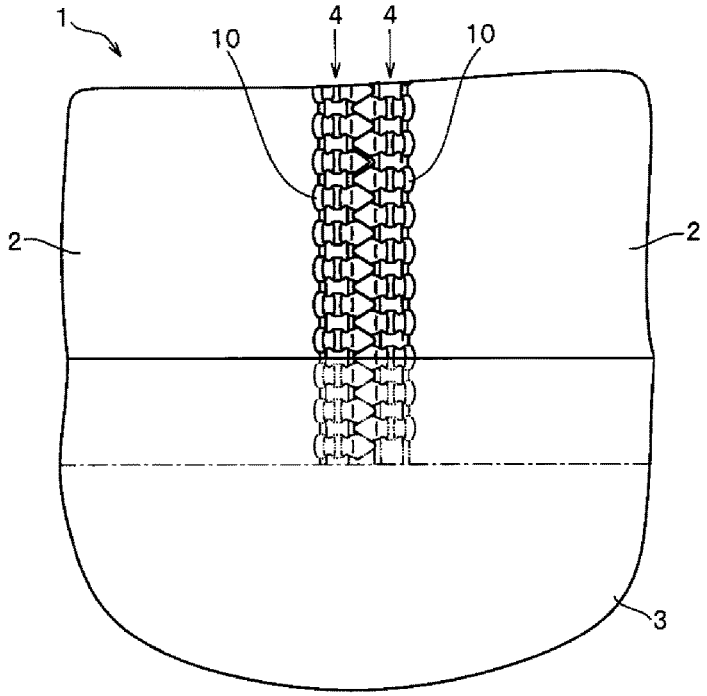
FIG. 3 is an enlarged view of a main part of the article with the slide fastener affixed thereto, in which a part thereof is perspectivally shown.
Figure 4:
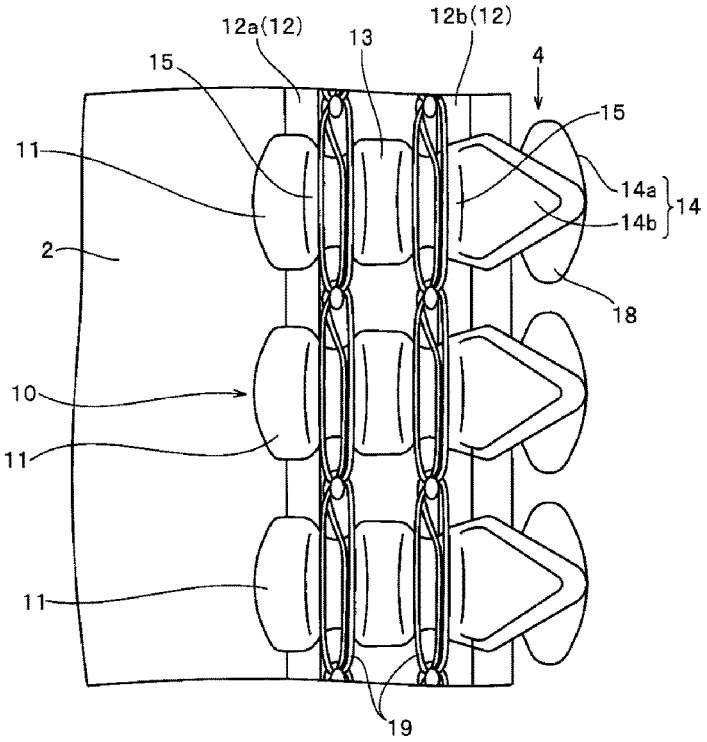
FIG. 4 is a further enlarged view of the main part of the article with the slide fastener affixed thereto.
Figure 5:
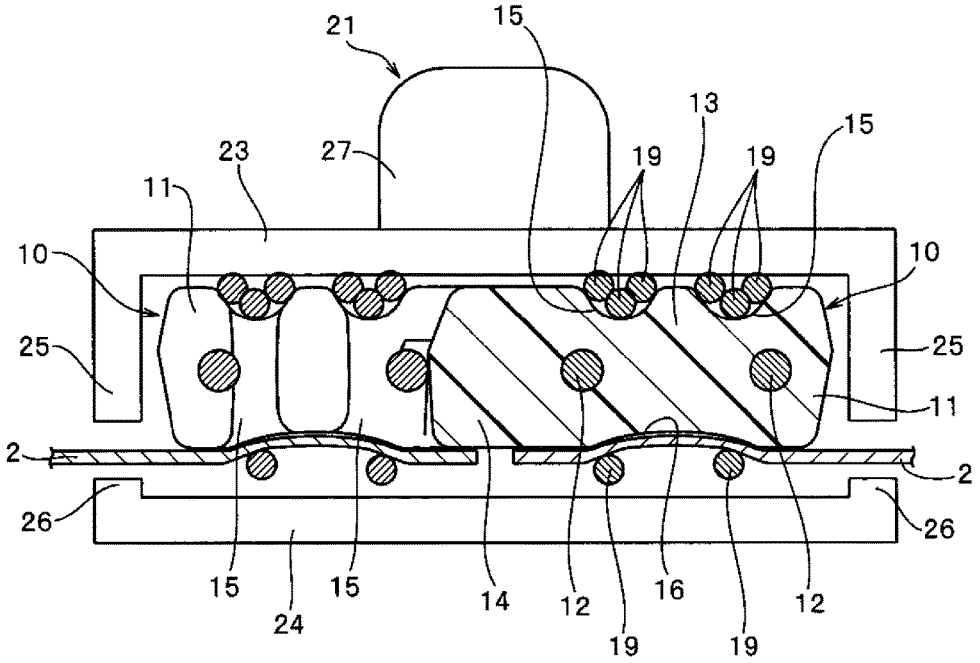
FIG. 5 is a sectional view illustrating a state where right and left element members are engaged in the article with the slide fastener affixed thereto.

FIG. 1 illustrates an outward appearance of a garment with a slide fastener affixed thereto according to a first illustrative embodiment. FIG. 2 is a front view of the garment with the slide fastener affixed thereto, and FIG. 3 is an enlarged view of a main part of the garment with the slide fastener affixed thereto, in which a part thereof is perspectively shown. FIG. 4 is a further enlarged view of the main part of the article with the slide fastener affixed thereto, and FIG. 5 is a sectional view illustrating a state where right and left element members are engaged in the article with the slide fastener affixed thereto. Meanwhile, in FIG. 1, the element members are not shown.

Also, in the description about the element members, a front and rear direction indicates a fastener length direction parallel with a slide direction of a slider. In particular, a direction along which the slider slides to engage the right and left element members is referred to as front, and a direction along which the slider slides to disengage the right and left element members is referred to as rear.

A right and left direction indicates a fastener width direction of the slide fastener (particularly, a width direction of the cloth becoming a fastener-attached member), and for example, is a direction orthogonal to the slide direction of the slider and parallel with an element member attachment surface of the fastener-attached member. Further, an upward and downward direction indicates a direction orthogonal to the front and rear direction and the right and left direction, and for example, is a fastener thickness direction orthogonal to the element member attachment surface of the fastener-attached member. In particular, a direction of a side of the element member on which a pull tap of the slider is arranged is referred to as an upward direction and an opposite direction thereto is referred to as a downward direction.

An article with a slide fastener affixed thereto according to the first illustrative embodiment is a garment (clothes) 1. Element members 10 and a slider 20 (which will be described later) are attached to an opening and closing part provided at a placket of a front body of the garment 1. That is, in the first illustrative embodiment, a cloth (also referred to as garment cloth) 2 configuring the placket of the garment 1 is a fastener-attached member to which the element member 10 is to be attached.

In the first illustrative embodiment, the slide fastener has a pair of right and left fastener stringers, each of which is configured by directly forming an element row 4 on the cloth 2 of the garment 1, and the slider 20 arranged to be slidable along the right and left element rows 4.

In the meantime, according to the slide fastener of the related art, in order to prevent the slider from separating from the element rows, the end stops are generally provided adjacent to front and rear ends of the element rows. However, according to the slide fastener of the first illustrative embodiment, instead of providing the end stops at the front end-side and the rear end-side of the element rows 4, a cloth piece 3 becoming a constitutional part of the garment 1 is sewn to overlap with front and rear end portions of the element rows 4 (refer to FIG. 3) (which will be described later).

In this way, the cloth piece 3 is sewn to the front and rear end portions of the element rows 4, so that the cloth piece 3 functions in the same manner as the end stops and prevents the slider 20 from separating from the front and rear ends of the element rows 4. In the meantime, according to the present invention, instead of the configuration where the cloth 2 is sewn with being overlapped to the element rows 4, like the first illustrative embodiment, the end stops may be formed into a predetermined shape adjacent to the front ends and rear ends of the element rows 4 or end stop components may be fitted to fastener elements 11 arranged at the front and rear end portions of the element rows 4 so that the slider 20 is prevented from separating from the element rows 4.

In addition, when a resin film is bonded or welded to the front and rear end portions of the element rows 4, when the extension portion of the cloth 2 extending from the front and rear end portions of the element rows 4 is folded back and sewn or when the front and rear end portions of the right and left element rows 4 are sewn in the fastener with direction with being engaged, it is possible to prevent the slider 20 from separating from the element rows 4, without forming the end stops. Further, according to the present invention, a separable bottom end stop having a separable pin, a retainer pin and a retainer box may be provided instead of the end stop.

In the first illustrative embodiment, each of the right and left fastener stringers has the cloth (fastener-attached member) 2 of the article, which also functions as the fastener tape, and the element member 10 fixed to the cloth 2 by two sets of sewing threads 19.

The cloth 2, which is the fastener-attached member, is the cloth 2 configuring the placket of the garment and has performance and properties (flexibility, thickness, texture, coloring and the like) necessary for the garment. In the first illustrative embodiment, the cloth 2 to which the element member 10 is sewn is cut out into predetermined shape and size, depending on a shape, a design and the like of the garment. In particular, considering the weight saving, the cloth 2, which is the fastener-attached member, and the cloth of the other parts are thinner (0.4 mm to 0.7 mm) than a thickness (1.1 mm to 1.5 mm) of the general fastener tape of the related art.

Also, a reinforcement sheet member such as a resin film (not shown) may be bonded to a front surface or back surface of the cloth 2 to which the element member 10 is sewn, so as to reinforce the cloth 2. Meanwhile, in the present invention, the configuration of the cloth 2 itself of the garment is not particularly limited and can be appropriately changed depending on the uses of the garment.

In the first illustrative embodiment, the element member 10 has a plurality of single fastener elements (single elements) 11 each of which has an engaging head 18, and two connecting string-shaped members 12 connecting the plurality of fastener elements 11. In the first illustrative embodiment, the fastener element 11 and the connecting string-shaped member 12 have substantially the same configurations as the fastener element and the connecting string-shaped member used for the slide fastener disclosed in Patent Document 1. Meanwhile, in the present invention, the plurality of fastener elements 11 can be connected to configure the element member by one connecting string-shaped member 12. In the below, the element member 10 of the first illustrative embodiment is described in detail.

In the first illustrative embodiment, the plurality of fastener elements 11 configuring the element member 10 is aligned side by side in the fastener length direction with being connected at an equal interval by the two connecting string-shaped members 12. The plurality of fastener elements 11 is integrally formed with the connecting string-shaped members 12 by injection molding a thermoplastic resin such as polyamide, polyacetal, polypropylene, polybutylene terephthalate and the like to the two connecting string-shaped members 12, for example.

Meanwhile, in the present invention, the material of the fastener elements 11 is not limited to the synthetic resin. For example, the fastener elements 11 may be made of the other synthetic resins or metal. Also, the element member of the present invention is not limited to the configuration where the thermoplastic resin is injection molded to the connecting string-shaped members 12 to form the fastener elements 11. For example, the fastener elements formed into a predetermined shape by injection molding the thermoplastic resin may be fixed to the connecting string-shaped members by a welding, a bonding and the like.

In the first illustrative embodiment, the fastener element 11 has a body portion 13 fixed to the two connecting string-shaped members 12, and an extension portion 14 extending towards an outward direction of the cloth 2 (towards the engaging matching fastener stringer) in the fastener width direction from the body portion 13. The body portion 13 has a shape where a substantially rectangular cubic body having a predetermined length size (size in the front and rear direction) and a predetermined height size (size in the upward and downward direction) is formed with two recessed accommodation grooves 15 configured to accommodate the sewing threads 19.

In this case, the two accommodation grooves 15 are formed at positions spaced each other in an area of the body portion 13 between the two connecting string-shaped members 12, as grooves continuing to an upper surface-side and front and rear end surfaces-side of the body portion 13. Also, a lower surface (back surface) of the body portion 13 facing the cloth 2 is provided with a curved portion 16 curved concavely between the two connecting string-shaped members 12.

Further, an end surface (end surface opposite to the engaging head 18-side) of the body portion 13 facing an inside of the cloth 2 has a convex curve shape where a central portion in the fastener length direction is bulged towards the inside of the cloth 2, as seen from above. Thereby, when the slider 20 slides along the element rows 4, the friction occurring between right and left upper flange portions 25 of the slider 20 (which will be described later) and the fastener elements 11 is reduced to increase the slidability of the slider 20.

The extension portion 14 of the fastener element 11 protrudes outwardly from a side end edge of the cloth 2. Also, the extension portion 14 has a first extension portion 14*a*, which is arranged on a lower surface (first surface) becoming a side (lower side) facing the surface (first surface) of the cloth 2, and a second extension portion 14*b*, which is arranged on a side (upper side) exposed to the outside and becoming an upper surface (second surface) spaced from the surface (first surface) of the cloth 2. Also, although the first extension portion 14*a* and the second extension portion 14*b* have different shapes, the first extension portion 14*a* and the second extension portion 14*b* are integrally formed. Further, a height size of the first extension portion 14*a* is set to be greater than a height size of the second extension portion 14*b*.

The first extension portion 14*a* has a neck portion 17 extending from the body portion 13 and having a narrowed shape so as to reduce a length size and an oblong engaging head 18 further extending towards the outward direction of the cloth 2 from a tip portion of the neck portion 17 and enlarged in the fastener length direction. In this case, a length size of the engaging head 18 is set to be greater than a length size of the body portion 13.

The second extension portion 14*b* has a shape extending towards the outward direction of the cloth 2 from the body portion 13 and having a length size (size in the front and rear direction) gradually decreasing towards a tip thereof in the extending direction, and forms a substantially triangular shape, as seen from above. In this case, the second extension portion 14*b* is formed to overhang in the front and rear direction, with respect to the neck portion 17 of the first extension portion 14*a*. In the meantime, the engaging head 18 of the first extension portion 14*a* protrudes in the front and rear direction with respect to the second extension portion 14*b*.

In the first illustrative embodiment, the second extension portion 14*b* having a triangular shape has a shape and a size with which the second extension portions 14*b* of the right and left fastener elements 11 are contacted or come close to each other when the right and left element rows 4 of the garment 1 with the slide fastener affixed thereto are engaged with each other. Thereby, when the right and left element rows 4 are engaged with each other, the neck portions 17 and engaging heads 18 of the extension portions 14 are concealed and not seen well by the back surfaces of the second extension portions 14*b*.

The plurality of fastener elements 11 having the above configuration is configured by injection molding the synthetic resin to the two connecting string-shaped members 12 arranged in parallel. Also, the connecting string-shaped members 12 connecting the plurality of fastener elements 11 have a first connecting string-shaped member 12*a* inserted into the body portions 13 at an inside position of the cloth 2 and a second connecting string-shaped member 12*b* inserted into the body portions 13 at a position of the extension portion 14-side.

The first and second connecting string-shaped members 12*a*, 12*b* have a circular section and penetrate the respective fastener elements 11. Also, the first and second connecting string-shaped members 12*a*, 12*b* consist of string-shaped members such as multi filament threads. Meanwhile, in the present invention, the material of the connecting string-shaped members 12 is not particularly limited and can be made of mono filaments formed using the same synthetic resin as the fastener elements 11, other threads and the like. Also, the sectional shapes of the first and second connecting string-shaped members 12*a*, 12*b* can be arbitrarily changed, as needed.

In the element member 10 of the first illustrative embodiment, as described above, the plurality of fastener elements 11 is connected by the first and second connecting string-shaped members 12*a*, 12*b* arranged in parallel, so that postures (positional relation) of the respective fastener elements 11 and intervals between the respective fastener elements 11 are stably kept.

Also, the element member 10 of the first illustrative embodiment having the fastener elements 11 and the connecting string-shaped members 12 is sewn to the cloth 2 by a sewing machine with being arranged on the surface (first surface) of the cloth 2. In particular, in the first illustrative embodiment, the element member 10 is attached to the cloth 2 by a double chain stitch of the two sets of sewing threads 19.

In this case, the sewing thread 19 configuring the double chain stitch has a looper thread of the cloth 2 and fastener elements 11 and a needle thread traveling on the back surface of the cloth 2, piercing the cloth 2 at a predetermined interval and interlacing with the looper thread. Also, the looper thread is accommodated in the two accommodation grooves 15 formed at the body portion 13 of the fastener element 11 and restrains the cloth 2 and the body portion 13 of the fastener element 11 between the looper thread and the needle thread, so that the fastener element 11 is sewn and fixed to the cloth 2.

In this way, the two sets of sewing threads 19 are respectively accommodated in the accommodation grooves 15 of the fastener elements 11 and sew and fix the fastener elements 11 to the cloth 2, so that the positions of the sewing threads 19 are not deviated and the fastener elements 11 can be securely fixed by the sewing threads 19. For this reason, the attachment strength of the fastener elements 11 to the cloth 2 is improved, so that it is possible to prevent the fastener elements 11 from loosening or separating from the cloth 2.

Also, the double chain stitch is preferably adopted as the stitch form of the sewing threads 19 because the strength of the seam is high and the flexibility is improved. Also, even though the sewing threads 19 are cut, it is possible to make it difficult for the sewing threads 19 to fray.

Meanwhile, in the present invention, as the stitch form of the sewing threads 19, a form other than the double chain stitch may also be adopted. Also, in the present invention, for example, when the fastener elements 11 are configured without forming the accommodation grooves 15, the sewing threads 19 may be enabled to pierce the cloth 2 and to sew the fastener elements 11 to the cloth along the first and second connecting string-shaped members 12*a*, 12*b* of the element member 10.

In the first illustrative embodiment, as pictorially shown in FIGS. 2 and 5, the slider 20 to be attached to the element rows 4 has a slider body 21 and a pull tap 22 having an attachment shaft portion at one end portion.

Also, the slider body 21 has an upper blade 23, a lower blade 24 spaced from and arranged in parallel with the upper blade 23, a guide post (not shown) configured to connect front end portions (shoulder mouth side end portions) of the upper and lower blades 23, 24, upper flange portions 25 provided to vertically extend from right and left side edge portions of the upper blade 23 towards the lower blade 24, ridge portions 26 arranged at right and left side edge portions of the lower blade 24, and a pull tap attachment portion 27 arranged on an upper surface of the upper blade 23.

A front end portion of the slider body 21 is formed with right and left shoulder mouths with the guide post being interposed therebetween, and a rear end portion of the slider body 21 is formed with a rear mouth. Also, a substantially Y-shaped element guide path configured to communicate the right and left shoulder mouths and the rear mouth each other is formed between the upper and lower blades 23, 24. Particularly, in the first illustrative embodiment, the element guide path of the slider 20 is configured to have such a size that the element member 10 and the garment cloth 2 can be inserted therein. By using the slider 20 having the configuration, it is possible to smoothly engage and disengage the right and left element members 10 directly sewn to the garment cloth 2.

Subsequently, a method of producing the garment 1 with the slide fastener affixed thereto of the first illustrative embodiment having the element members 10 is described. First, the element member 10 and the cloth 2 for garment (cloth 2 before the cutting) are produced. As described above, the element member 10 of the first illustrative embodiment is produced by directly injection molding the synthetic resin to the two connecting string-shaped members 12 arranged to be parallel to thus form the plurality of fastener elements 11 having a predetermined shape.

In the meantime, differently from the element member 10, the cloth 2 for garment becoming the fastener-attached member is produced by the knitting, weaving and the like. At this time, for example, when it is intended to impart the waterproofness to the cloth 2, the knitted or woven cloth 2 may be coated with the synthetic resin or bonded with the resin film.

Figure 6:
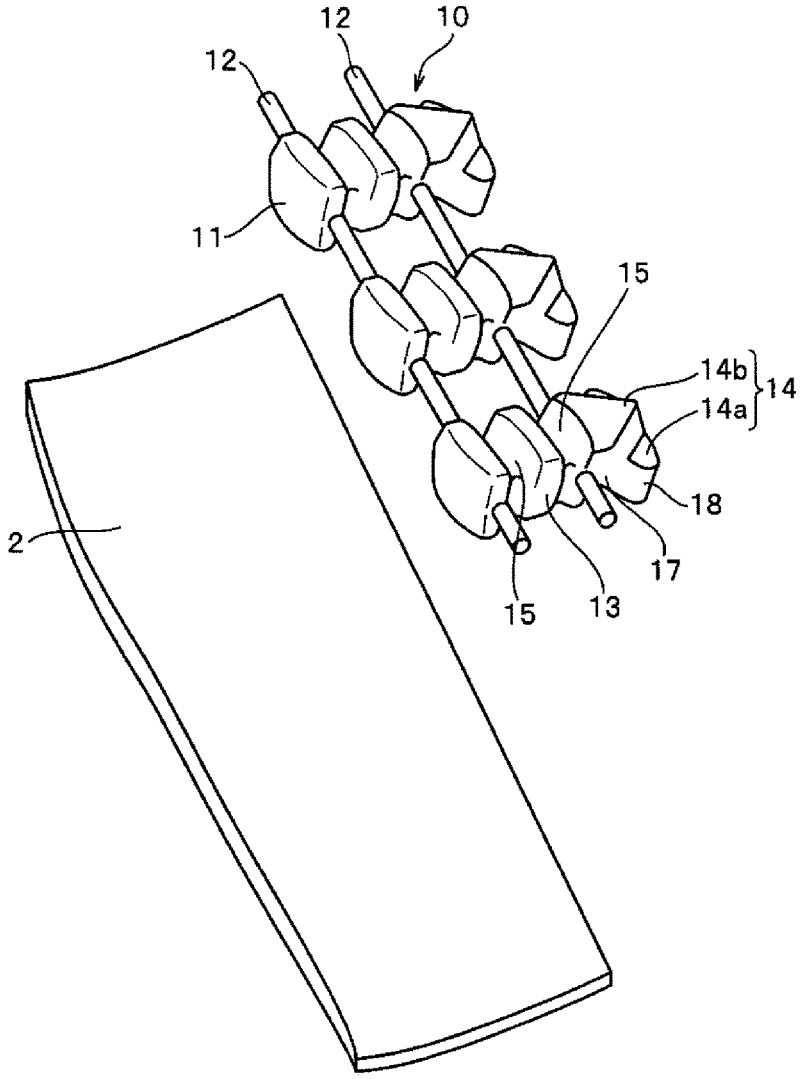
FIG. 6 is a perspective view illustrating a state before the element member is sewn to a fastener-attached member.

Then, the constitutional part 5 for garment having the element member 10 is produced using the element member 10 and cloth 2 produced as described above. For example, the element member 10 shown in FIG. 6 is sewn to the part becoming the placket of the cloth 2 configuring a front body of the garment by the sewing machine.

Figure 7:
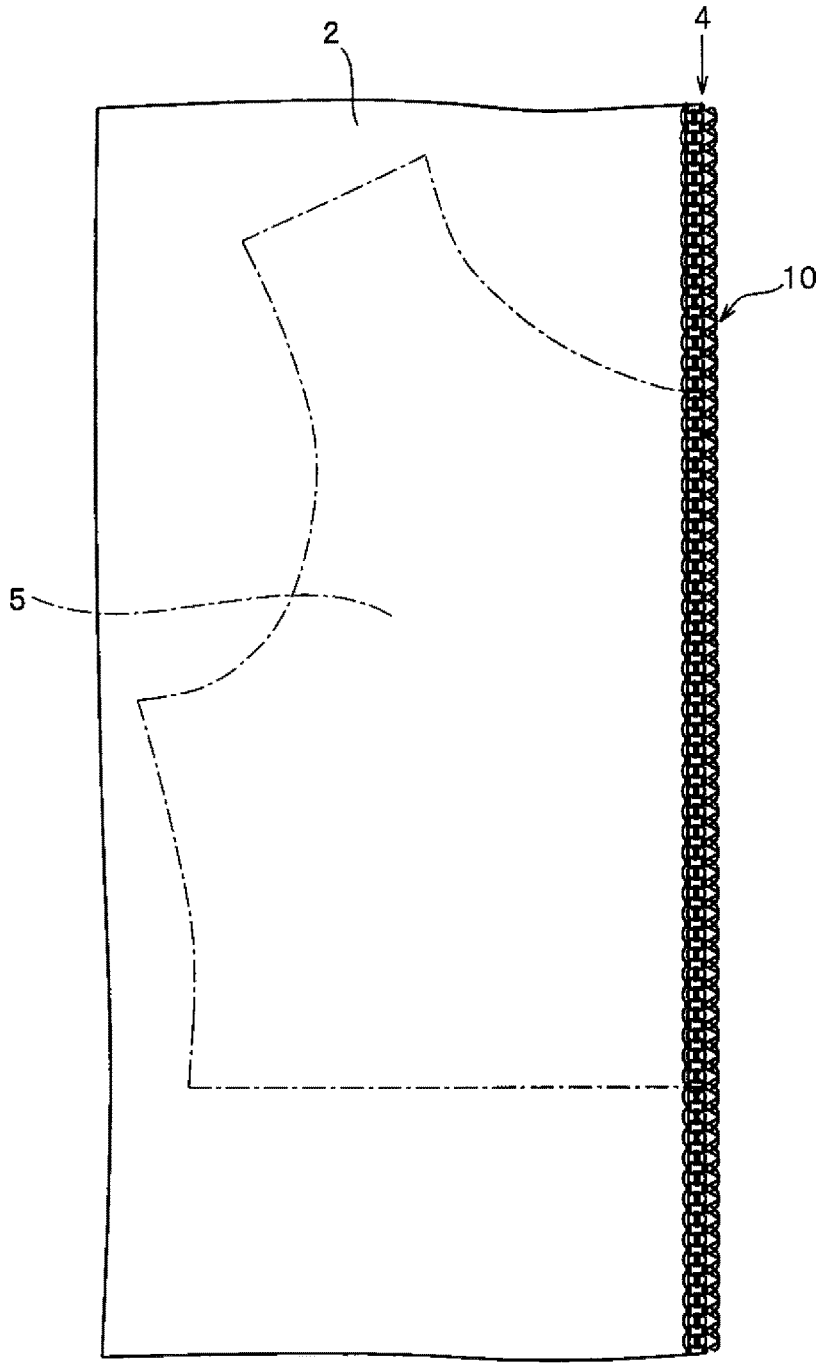
FIG. 7 is a plan view illustrating the fastener-attached member to which the element member is sewn.

At this time, the element member 10 is sewn with being arranged on the surface of the cloth 2 by the sewing machine, so that the two sets of sewing threads 19 are respectively guided and accommodated in the two accommodation grooves 15 formed on the body portions 13 of the fastener elements 11 and the body portions 13 of the fastener elements 11 are sewn to the cloth 2 by the double chain stitch of the respective sewing threads 19. Thereby, the cloth 2 with the element member 10 affixed thereto as shown in FIG. 7 is obtained.

Figure 8:
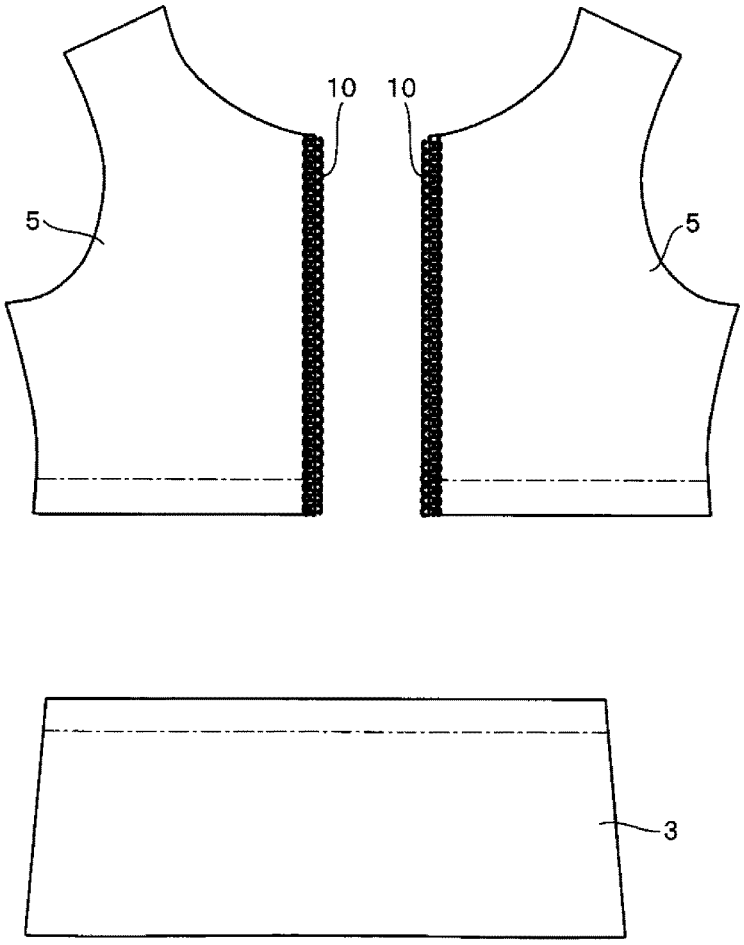
FIG. 8 is a plan view illustrating constitutional parts of the article with the slide fastener affixed thereto.

Subsequently, the obtained cloth 2 with the element member 10 affixed thereto is cut out to have a predetermined shape corresponding to the front body of the garment. For example, as shown with the dashed-dotted line in FIG. 7, the cloth 2 is cut out into a predetermined shape and the element member 10 sewn to the cloth 2 is cut out (cut) in conformity to the shape of the cloth 2. Thereby, the constitutional part 5 for the front body having the element member 10 attached thereto is produced. At this time, as shown in FIG. 8, a pair of right and left line-symmetric constitutional parts 5 is produced. Meanwhile, in FIG. 8, the dashed-dotted line indicates a seam allowance part.

At this time, the cloth 2 is preferably cut out so that the element member 10 sewn to the cloth 2 is cut at the positions of the connecting string-shaped members 12, not the positions of the fastener elements 11 of the element member 10. Thereby, since it is possible to effectively and correctly cut the element member 10, it is possible to stably cut out the cloth 2 with the element member 10 affixed thereto into a predetermined shape.

In addition to the pair of right and left constitutional parts 5 for the front body, a constitutional part 3 (cloth piece 3) to be sewn to lower end portions of the constitutional parts for the front body, constitutional parts (cloth pieces) (not shown) configuring right and left sleeves and a rear body, a constitutional part (cloth piece) (not shown) to be attached in the vicinity of a neck of the front body, and the like are produced and prepared.

In particular, the constitutional parts 5 for the front body and the constitutional parts (cloth pieces) configuring the right and left sleeves and rear body are equivalent in terms of the flexibility, the thickness and the coloring as the required performance and properties. Since the coloring relates to the design, the same color may be made or colors of some constitutional parts may be changed.

After that, the produced constitutional parts of the respective regions are connected to assemble a garment by the sewing and the like. Also, the slider 20 is slidably attached to the element rows 4 formed by sewing the element members 10 to the cloth 2. Thereby, it is possible to stably produce the garment 1 with the slide fastener affixed thereto as shown in FIG. 1.

According to the garment 1 with the slide fastener affixed thereto of the first illustrative embodiment, since a part of the garment cloth 2 not only configures the garment but also functions as the fastener tape of the slide fastener, it is possible to omit the fastener tape that is necessarily provided for the slide fastener of the related art. The fastener tape is not required any more, so that it is possible to reduce the producing cost (particularly, the cost relating to the material) of the garment 1 with the slide fastener affixed thereto. Also, it is possible to reduce the weight of the garment 1 with the slide fastener affixed thereto and to improve the flexibility. In particular, according to the garment 1 of the first illustrative embodiment, it is possible to increase the flexibility of the placket of the garment in the front and back direction of the cloth 2.

Further, according to the first illustrative embodiment, since it is possible to directly sew the element members 10 to the cloth 2 after imparting the desired function such as waterproofness and water repellency to the cloth 2, for example, it is possible to easily produce the garment 1 with the high-quality slide fastener affixed thereto having the waterproofness, water repellency and the like.

In the meantime, according to the first illustrative embodiment, when producing the garment 1 with the slide fastener affixed thereto, the constitutional part 5 for the front body is produced by sewing the element member 10 to the cloth 2 before the cutting and then cutting out the cloth 2 with the element member 10 affixed thereto into a predetermined shape. However, in the present invention, the process of producing the constitutional part is not limited to the aspect of the first illustrative embodiment. For example, it is possible to produce the constitutional part 5 for the front body by using a following method.

Figure 9:
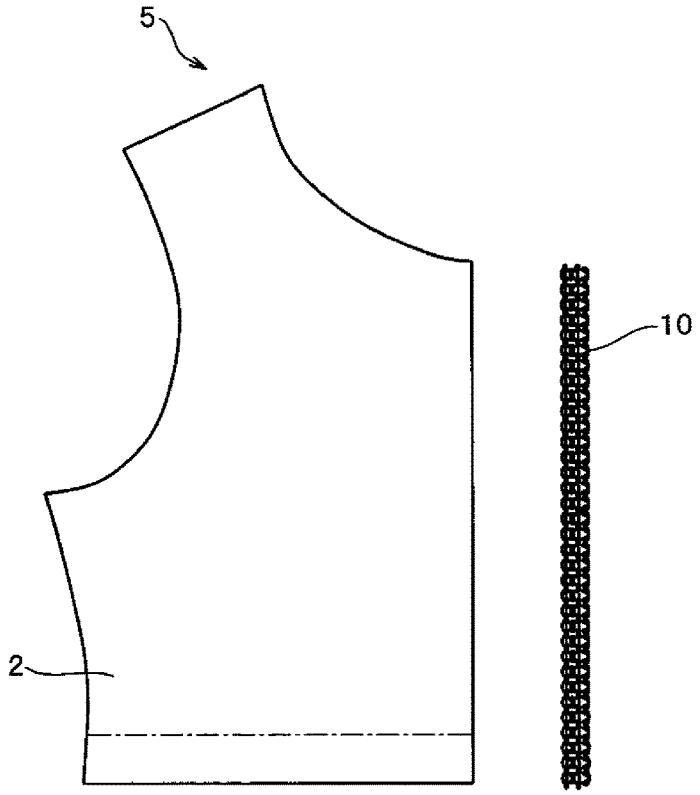
FIG. 9 is a plan view illustrating a state before the element member is sewn to the fastener-attached member in a production method of another aspect.

For example, as shown in FIG. 9, before sewing the element member 10 to the cloth 2, the cloth 2 is cut out into a predetermined shape. Also, separately from the cloth 2, the element member 10 is cut to have a predetermined length size (length size actually required) corresponding to a size of the cut cloth 2.

After that, the element member 10 having the predetermined length size is attached to the cloth 2 cut into a predetermined shape by the sewing, so that the constitutional part 5 for the front body can be produced. In this case, a length of the cut cloth 2 to which the element member 10 is to be attached and a length of the element row 4 by the element member 10 having a predetermined length are the same.

As an additional method, before the element member 10 is sewn to the cloth 2, the cloth 2 is preliminarily cut out into a rough shape (schematic shape). Subsequently, the element member 10 or the element member 10 cut to have a predetermined length size (size longer than the length size actually required) is attached to the preliminarily cut cloth 2 by the sewing, so that the cloth 2 with the element member 10 affixed thereto is produced. After that, the cloth 2 with the element member 10 affixed thereto is cut out into a predetermined shape. By using this method, it is also possible to produce the constitutional part 5 for the front body.

Figure 10:
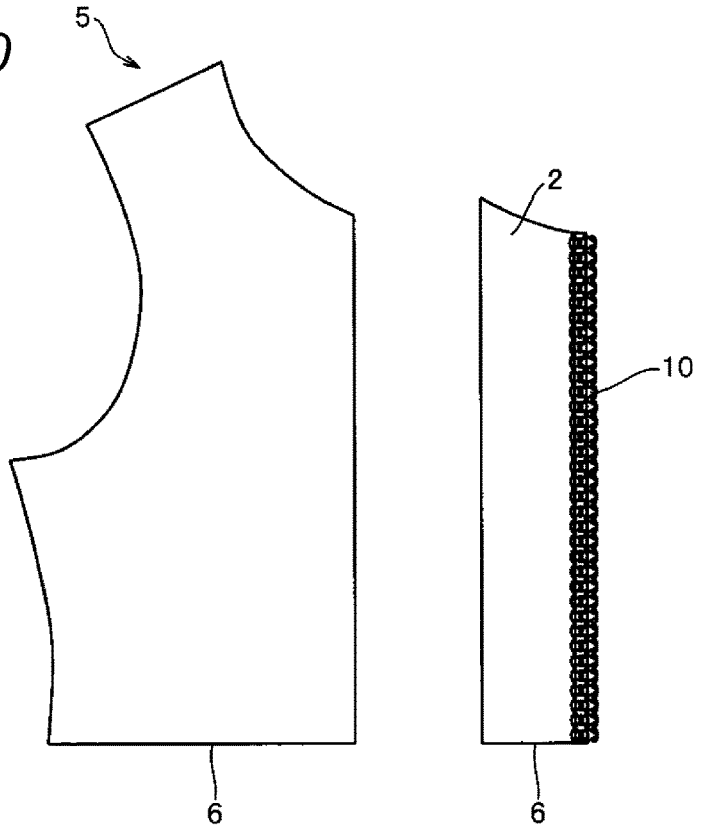
FIG. 10 is a plan view illustrating a state before the constitutional parts are produced in a production method of still another aspect.
Figure 11:
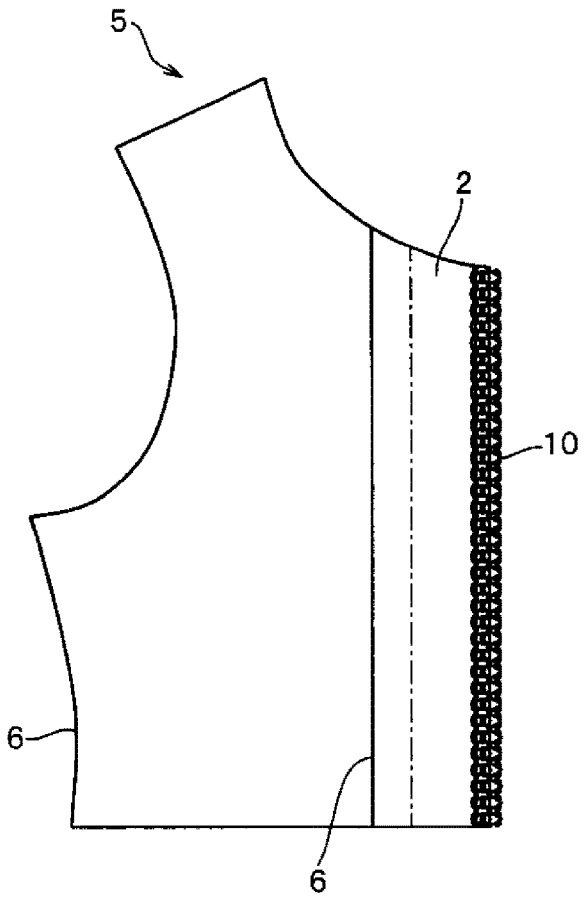
FIG. 11 is a plan view of the produced constitutional part.

Further, for example, as shown in FIGS. 10 and 11, a plurality of cloth pieces 6 (including a cloth piece 6 of which the element member 10 is sewn to the cloth 2) is connected by the sewing or the welding by a ultrasonic welding means and the like, so that one constitutional part (for example, the constitutional part 5 for the front body) can be produced. In this way, the plurality of cloth pieces 6 is connected to produce the constitutional part, so that it is possible to stably produce an article with a slide fastener affixed thereto having a large size into a predetermined shape.

In the meantime, the cloth piece 6 having the element member 10 sewn thereto is cut out at positions at which it is aligned at both end portions of the element member 10 in the longitudinal direction. At both end portions of the element member 10, the cloth piece 6 is cut out so that at least one side end portion is curved or inclined. The curved or inclined portion configures a shape around a neck of the front body when the garment 1 is configured. The other side end portion may also be cut out to have a curved or inclined shape. However, regarding the constitutional part 5 becoming the front body of the garment 1, the other side is preferably cut out to have a linear shape in a direction orthogonal to the longitudinal direction of the element member 10.

Second Illustrative Embodiment

Figure 12:
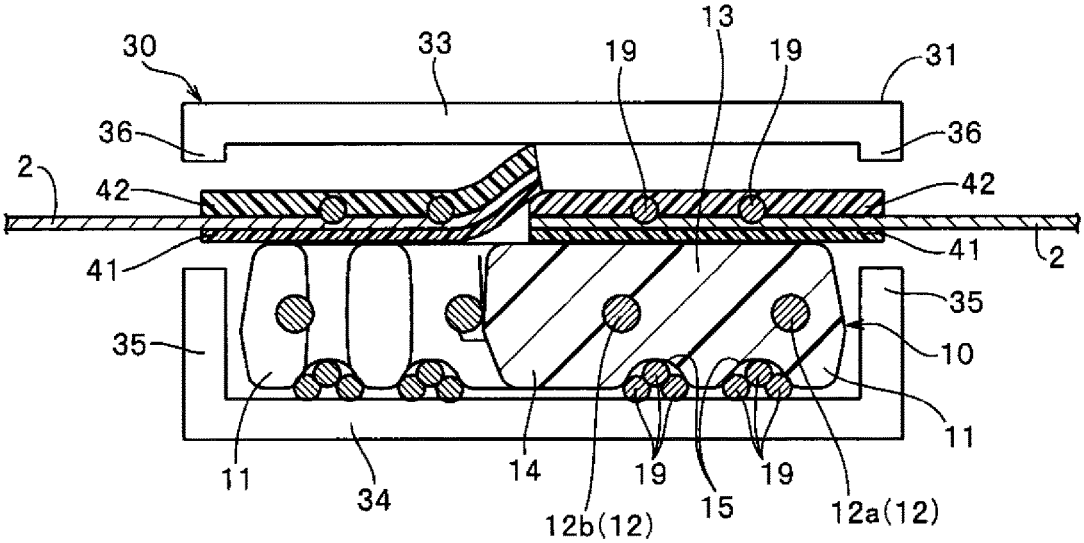
FIG. 12 is a sectional view illustrating a main part of an article with a slide fastener affixed thereto according to a second illustrative embodiment of the present invention.
Figure 13:
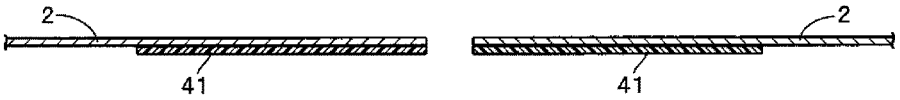
FIG. 13 is a sectional view illustrating a fastener-attached member and a reinforcement sheet member before the element member is attached thereto in the production of the article with the slide fastener affixed thereto.
Figure 14:
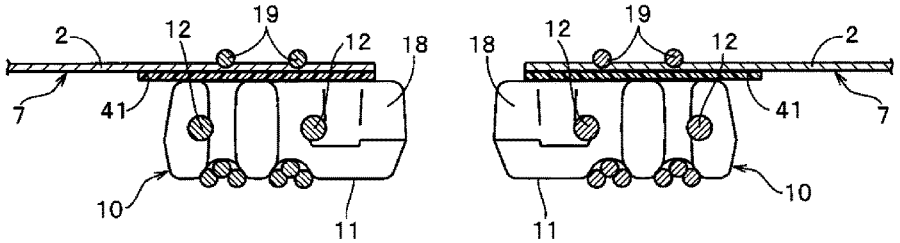
FIG. 14 is a sectional view illustrating a state where the element member is attached to the fastener-attached member and reinforcement sheet member in the production of the article with the slide fastener affixed thereto.
Figure 15:
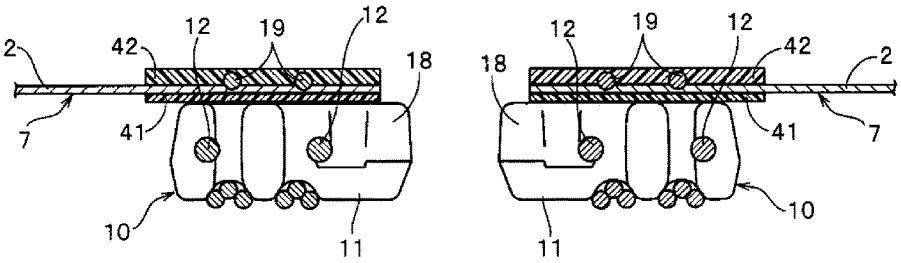
FIG. 15 is a sectional view illustrating a state where a waterproof layer is formed on the fastener-attached member in the production of the article with the slide fastener affixed thereto.

FIG. 12 is a sectional view illustrating a main part of an article with a slide fastener affixed thereto according to a second illustrative embodiment of the present invention. FIGS. 13 to 15 are sectional views illustrating a producing process of the article with the slide fastener affixed thereto.

In the meantime, in the second illustrative embodiment and a third illustrative embodiment (which will be described later), the components and members having the substantially same configurations as the first illustrative embodiment are denoted with the same reference numerals and the descriptions thereof are omitted.

In the second illustrative embodiment, the slide fastener has a pair of right and left fastener stringers configured by directly forming the element rows on the garment cloth 2, and a slider 30 arranged to be slidable along the right and left element rows. Also, in the second illustrative embodiment, the slide fastener is configured in a so-called reverse use aspect where the element rows are arranged on the back surface-side (inner surface-side) of the cloth 2 so that the slide fastener is not seen well from the outer surface-side of the garment.

In the second illustrative embodiment, the right and left fastener stringers have the article cloth (fastener-attached member) 2 also functioning as the fastener tape and the element member 10 fixed to the cloth 2 by the two sets of sewing threads 19. In this case, the element member 10 has the same configuration as the element member 10 of the first illustrative embodiment, except that the fastener element 11 is not provided with the curved portion 16.

The cloth 2, which is the fastener-attached member, is the cloth 2 configuring the placket of the garment. The cloth 2 is coated with the synthetic resin on a surface (outer surface) becoming the second surface of the cloth 2 so that the waterproofness is imparted to the cloth 2 so as to prevent the liquid such as water (rainwater) from permeating thereinto.

Also, a reinforcement sheet member 41 such as resin film is attached to the back surface (first surface) of the side edge portion of the cloth 2, to which the element member 10 is to be attached, by the bonding using an adhesive. Also, the reinforcement sheet member 41 is sewn to the cloth 2 by the sewing threads 19 together with the element member 10. For this reason, the sewing threads 19 passes between the respective fastener elements 11 from the surface of the element member 10, pierce the reinforcement sheet member 41 and the cloth 2 and sew and fix the element member 10, the reinforcement sheet member 41 and the cloth 2 together.

In this way, the reinforcement sheet member 41 is attached to the side edge portion of the cloth 2, so that the side edge portion of the cloth 2 is reinforced. Also, the attachment strength of the element member 10 sewn to the cloth 2 and reinforcement sheet member 41 is improved. In this case, the reinforcement sheet member 41 has a thickness of about 0.7 mm to 0.8 mm, and at a state where the reinforcement sheet member 41 is attached to the cloth 2, a thickness of the attached portion is about 1.1 mm to 1.5 mm.

In this case, the reinforcement sheet member 41 is provided between the element member 10 and the fastener-attached member and extends and is attached to a more inner area of the cloth 2 than the element member 10 in the fastener width direction. In this way, the reinforcement sheet member 41 is provided between the element member 10 and the fastener-attached member, so that the reinforcement sheet member 41 is concealed between the element member 10 and the fastener-attached member and thus is not seen well from the outside.

Also, the reinforcement sheet member 41 is arranged at the more inner side of the cloth 2 than the element member 10 in the fastener width direction, so that the cloth 2 can be reinforced over a wide range. Also, at least a part of the reinforcement sheet member 41 is positioned on an extension line of lower flange portions 35 (which will be described later) of the slider 30 between the lower flange portions 35 and the cloth 2, so that it is possible to make it difficult for the lower flange portions 35 to directly slide to the cloth 2. Therefore, it is possible to suppress the cloth 2 from being worn due to the friction with the lower flange portions 35 occurring upon the sliding of the slider 30.

In particular, when the slider 30 is slid to engage the element members 10, since the cloth 2 is guided into an element guide path (which will be described later) of the slider 30 an insertion gap formed between the lower flange portions 35 and the ridge portions 36, the lower flange portions 35 and the cloth 2 are likely to sliding-contact each other. For this reason, the reinforcement sheet member 41 is provided, as described above, so that it is possible to effectively protect the cloth 2, as compared to a configuration where the cloth 2 is exposed to the lower flange portions 35-side.

Meanwhile, in the second illustrative embodiment, the reinforcement sheet member 41 is bonded to the back surface (first surface) of the cloth 2, to which the element member 10 is to be attached, by an adhesive. However, in the present invention, the reinforcement sheet member 41 may be bonded only to the front surface (second surface) opposite to the back surface (first surface) of the cloth 2, to which the element member 10 is to be attached, or may be bonded to both the back surface (first surface) and the front surface (second surface) of the cloth 2. Also, as the means for affixing the reinforcement sheet member 41 to the cloth 2, a welding means such as high-frequency welding may be used instead of the bonding means by the adhesive.

Also, in the second illustrative embodiment, a waterproof layer 42 made of a synthetic resin is arranged on the front surface (second surface) of the side edge portion of the cloth 2 to which the element member 10 is to be attached. The waterproof layer 42 is formed after the element member 10 is sewn to the cloth 2, and is configured by thinly depositing polyurethane-based, polyester-based, polyamide-based or vinyl chloride-based thermoplastic elastomer on the side edge portion of the cloth 2.

Meanwhile, in the present invention, the material of the waterproof layer 42 is not particularly limited and can be arbitrarily selected. Also, instead of forming the waterproof layer 42, a film (resin film) made of a synthetic resin may be bonded or welded on the front surface (second surface) of the side edge portion of the cloth 2.

Also, according to the garment with the slide fastener affixed thereto of the second illustrative embodiment, the sewing position of the element member 10 to the cloth 2 is adjusted so that when the right and left element rows are engaged, the side edge portions of the right and left clothes 2 and waterproof layers 42 overlap vertically. In this way, when the element rows are engaged, the side edge portions of the right and left clothes 2 and waterproof layers 42 overlap vertically, so that it is possible to effectively prevent the liquid such as water from being introduced from the front surface of the cloth 2 to the back surface through a boundary of the right and left clothes 2.

Meanwhile, in the present invention, even though the side edge portions of the right and left clothes 2 and waterproof layers 42 do not overlap vertically upon the engagement of the element rows, unlike the second illustrative embodiment, when the side edge portions (particularly, side end surfaces of the side edge portions) of the right and left clothes 2 and waterproof layers 42 are contacted, preferably closely contacted to each other, it is possible to prevent the liquid such as water from being introduced from the front surface of the cloth 2 to the back surface through a boundary of the right and left clothes 2.

In order to enable the side edge portions of the waterproof layers 42 to contact each other upon the engagement, the respective side edge portions of the right and left waterproof layers 42 are arranged at the same position as a center of the element row in the tape width direction at the state where the right and left element rows are engaged or arranged to extend towards the engaging matching side beyond the center. Alternatively, one waterproof layer 42 may be made to extend beyond the center of the element row in the tape width direction until it is contacted to the other waterproof layer 42.

In the second illustrative embodiment, the slider 30 is configured as a slider for a slide fastener in a reverse use aspect, as shown in FIG. 12.

Specifically, the slider 30 of the second illustrative embodiment has a slider body 31, and a pull tap (not shown) having an attachment shaft portion at one end portion. Also, the slider body 31 has an upper blade 33, a lower blade 34 spaced from and arranged in parallel with the upper blade 33, a guide post (not shown) configured to connect front end portions (shoulder mouth-side end portions) of the upper and lower blades 33, 34, lower flange portions 35 provided to extend from right and left side edge portions of the lower blade 34 towards the upper blade 33, ridge portions 36 arranged at right and left side edge portions of the upper blade 33, and a pull tap attachment portion (not shown) arranged on an upper surface of the upper blade 33.

A front end portion of the slider body 31 is formed with right and left shoulder mouths with the guide post being interposed therebetween, and a rear end portion of the slider body 31 is formed with a rear mouth. Also, a substantially Y-shaped element guide path configured to communicate the right and left shoulder mouths and the rear mouth each other is formed between the upper and lower blades 33, 34. The element guide path is configured to have such a size that the element member and the garment cloth can be inserted therein.

The garment with the slide fastener affixed thereto of the second illustrative embodiment can be produced using a following method.

First, the element member 10 and the cloth 2 for garment (cloth 2 before the cutting) are prepared. The element member 10 of the second illustrative embodiment can be produced by the same method as the first illustrative embodiment. Also, the cloth 2 for garment becoming the fastener-attached member is produced by coating a synthetic resin to the knitted fabric or woven fabric. Then, as shown in FIG. 13, the reinforcement sheet member 41 is bonded onto the back surface of the produced cloth 2 by the adhesive.

Then, the cloth 2 having the reinforcement sheet member 41 bonded thereto and the produced element member 10 are sewn using the same method as the first illustrative embodiment so that the reinforcement sheet member 41 is positioned between the cloth 2 and the element member 10. Thereby, for example, as shown in FIG. 14, a constitutional part 7 for garment of which the element member 10, the reinforcement sheet member 41 and the cloth 2 are unitarily sewn is produced.

In this way, the element member 10, the reinforcement sheet member 41 and the cloth 2 are sewn by the sewing threads 19 so that the reinforcement sheet member 41 is positioned between the element member 10 and the cloth 2. Thereby, the cloth 2 is stably reinforced by the reinforcement sheet member 41 and the reinforcement sheet member 41 is not seen well from the outside, so that it is possible to suppress the outward appearance quality of the garment from being lowered.

After that, the waterproof layer 42 made of a synthetic resin is formed on the front surface (second surface) of the side edge portion of the cloth 2, to which the element member 10 is sewn, of the obtained constitutional part 7 for garment. The waterproof layer 42 consists of a film made of a synthetic resin, for example, and can prevent the liquid such as water from passing therethrough.

The waterproof layer 42 is formed in this way, so that when sewing the element member 10, the reinforcement sheet member 41 and the cloth 2, it is possible to plug needle holes (holes formed by the sewing machine needle) formed in the cloth 2 by the waterproof layer 42 and to cover the sewing threads 19 (i.e., sewing threads configuring the double chain stitch) traveling on the surface of the cloth 2 by the waterproof layer 42. Thereby, since it is possible to effectively prevent the liquid such as water from being transmitted through the needle holes formed in the cloth 2 or through the sewing threads 19 inserted into the needle holes and thus from being introduced from the front surface of the cloth 2 to the back surface, it is possible to considerably improve the waterproofness of the garment.

Meanwhile, in the second illustrative embodiment, as described above, after producing the constitutional part 7 for garment, the waterproof layer 42 is formed. However, according to the present invention, the process of forming the waterproof layer 42 may be performed at any step inasmuch as it is performed after the element member 10 is sewn to the cloth 2 by the sewing. For example, when the cloth 2 and the element member 10 are cut to produce the constitutional part after sewing the element member 10 to the cloth 2 by the sewing, the waterproof layer 42 may be formed after the sewing and before the cutting of the cloth 2 and element member 10.

After that, the produced constitutional parts of the respective regions are connected to assemble a garment by the sewing and the like. Also, the slider 30 is slidably attached to the element rows of the element members 10 sewn to the cloth 2. Thereby, the garment with the slide fastener affixed thereto of the second illustrative embodiment is produced.

According to the garment with the slide fastener affixed thereto of the second illustrative embodiment, like the garment 1 with the slide fastener affixed thereto of the first illustrative embodiment, the fastener tape is not required, so that the weight thereof is reduced and the flexibility of the garment is improved.

Further, according to the garment with the slide fastener affixed thereto of the second illustrative embodiment, as described above, the side edge portions of the right and left clothes 2 and waterproof layers 42 overlap vertically upon the engagement of the element rows, so that it is possible to effectively prevent the liquid such as water from being introduced from the front surface of the cloth 2 to the back surface through the boundary of the right and left clothes 2.

Also, the synthetic resin is coated on the cloth 2 and the waterproof layer 42 is formed on the surface of the side edge portion of the cloth 2 to which the element member 10 is sewn. Thereby, it is possible to prevent the liquid from permeating into the cloth 2 to be introduced to the back surface of the cloth 2. Also, it is possible to prevent the liquid from being transmitted through the needle holes formed in the cloth 2 or through the sewing threads 19 inserted into the needle holes and thus from being introduced to the back surface of the cloth 2. Therefore, the garment with the slide fastener affixed thereto according to the second illustrative embodiment has the excellent waterproof performance capable of stably preventing the liquid from being introduced to the back surface of the cloth 2 when the right and left element rows are engaged each other.

Third Illustrative Embodiment

Figure 16:
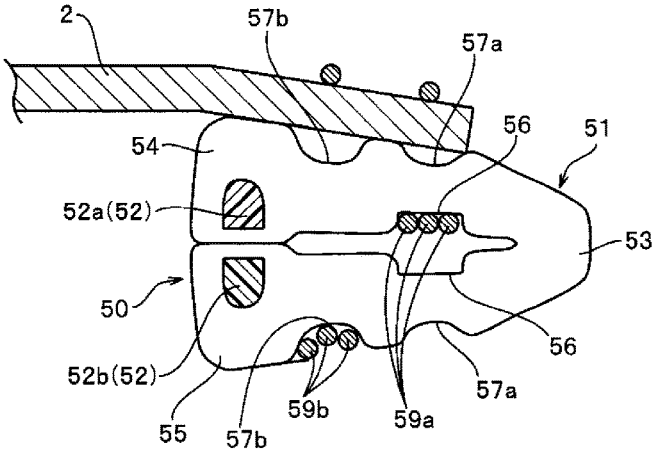
FIG. 16 is a sectional view illustrating a main part of an article with a slide fastener affixed thereto according to a third illustrative embodiment of the present invention.
Figure 17:
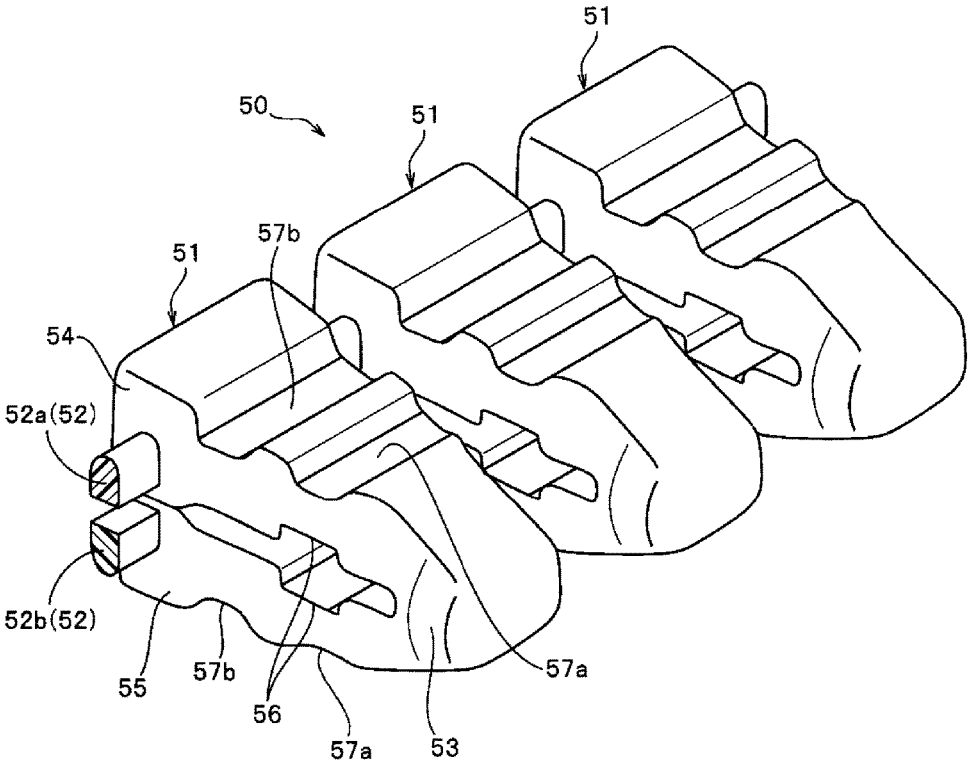
FIG. 17 is a perspective view illustrating the element member used for the article with the slide fastener affixed thereto.
Figure 18:
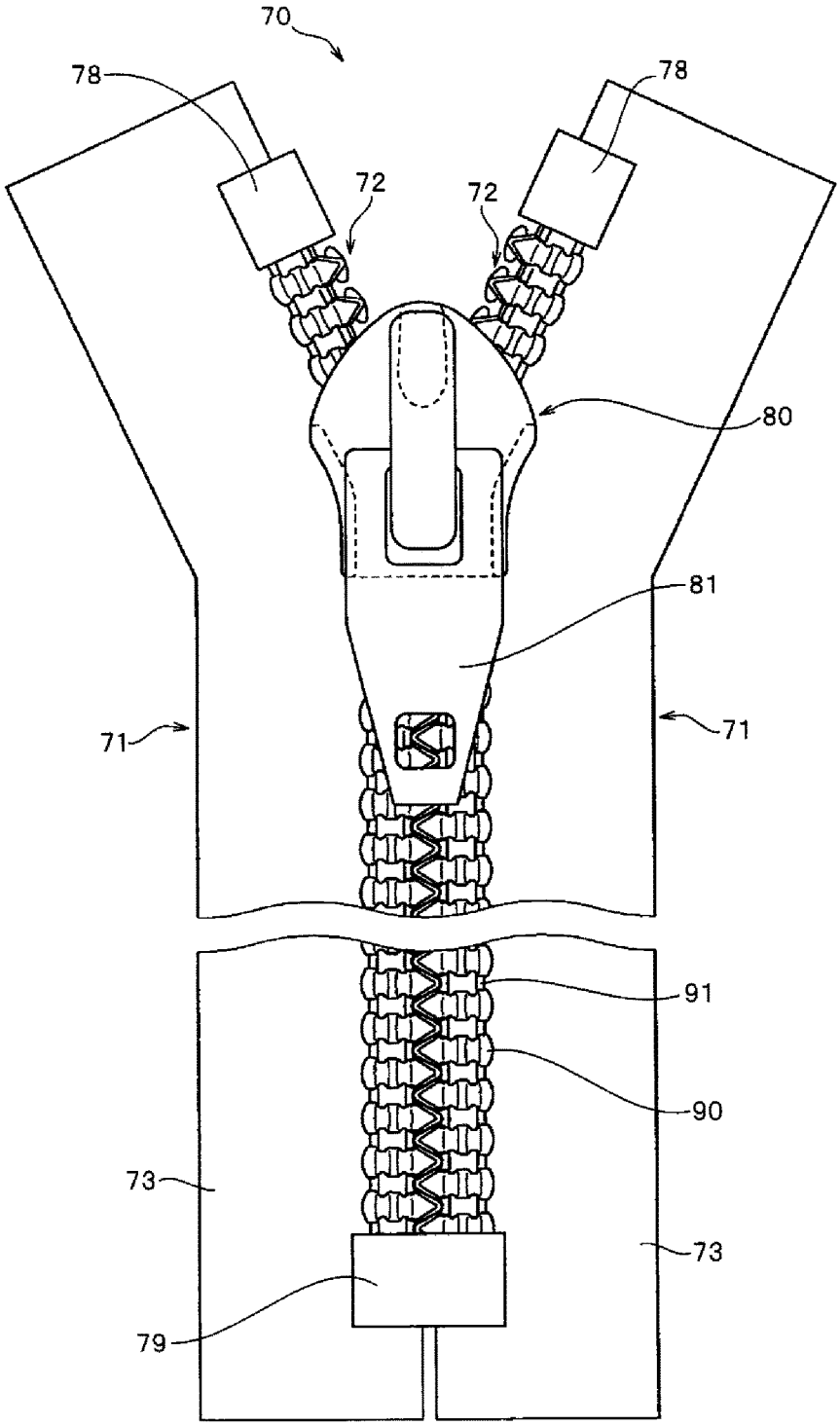
FIG. 18 is a plan view illustrating a slide fastener of the related art.
Figure 19:
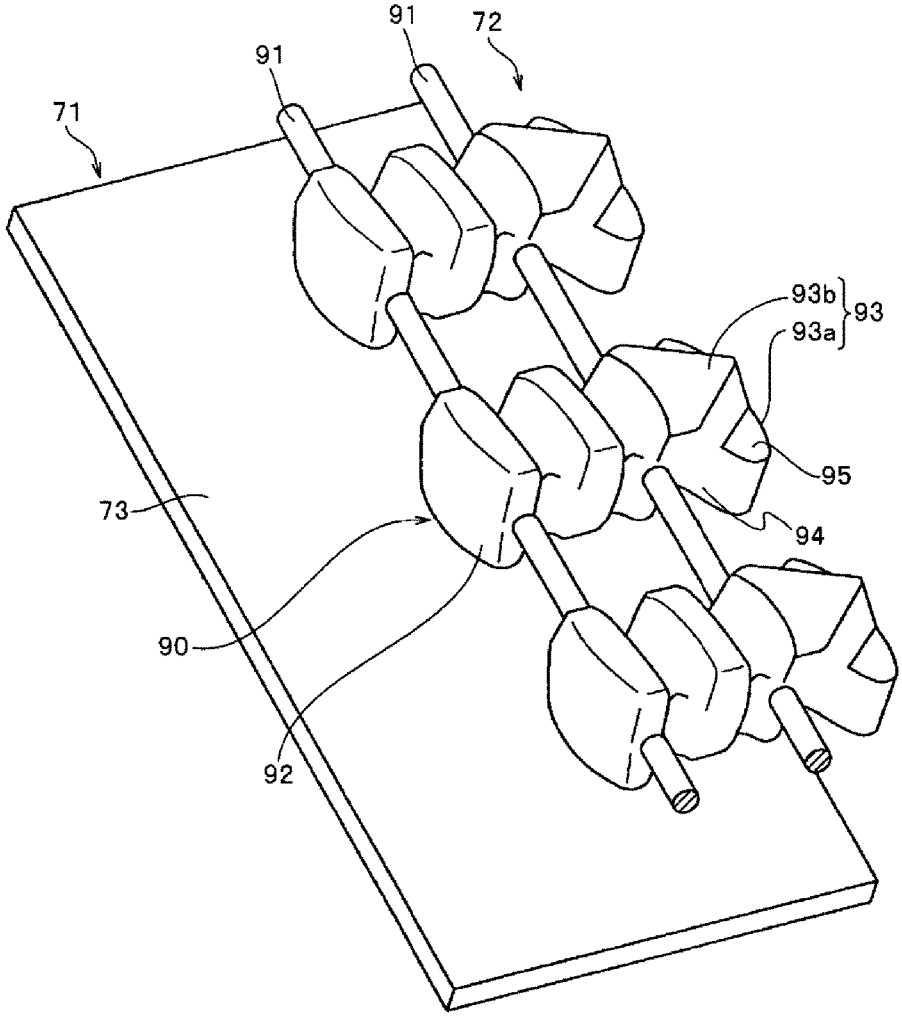
FIG. 19 is a perspective view illustrating a main part of the slide fastener of the related art.

FIG. 16 is a sectional view illustrating a main part of an article with a slide fastener affixed thereto according to a third illustrative embodiment. FIG. 17 is a perspective view illustrating the element members to be used for the article with the slide fastener affixed thereto.

In the garment with the slide fastener affixed thereto according to the third illustrative embodiment, the slide fastener has a pair of right and left fastener stringers configured by directly forming the element rows on the garment cloth 2, and a slider (not shown) arranged to be slidable along the right and left element rows.

The slide fastener of the third illustrative embodiment is configured in a so-called reverse use aspect where the element rows are arranged on the back surface-side (inner surface-side) of the garment cloth 2 so that the slide fastener is not seen well from the outer surface-side of the garment. Also, the slider of the third illustrative embodiment has substantially the same configuration as the slider 30 used for the garment with the slide fastener affixed thereto of the second illustrative embodiment.

In the third illustrative embodiment, the fastener stringer has the cloth 2 (fastener-attached member) becoming a placket of an article and an element member 50 fixed to the back surface (first surface) of the cloth 2 by a first sewing thread 59*a* and a second sewing thread 59*b*. Also, the element member 50 has a plurality of single fastener elements (single elements) 51 each of which has an engaging head 53, and two connecting string-shaped members 52 connecting the plurality of fastener elements 51 at a predetermined interval.

The plurality of fastener elements 51 is integrally formed with the connecting string-shaped members 52 by injection molding a thermoplastic resin such as polyamide, polyacetal, polypropylene, polybutylene terephthalate and the like to the two connecting string-shaped members 52, for example.

Also, in the third illustrative embodiment, each fastener element 51 has an engaging head 53 formed to be bendable, and a first leg portion 54 and a second leg portion 55 bifurcating vertically from the engaging head 53 and extending in the fastener width direction.

In this case, the first leg portion 54 is a leg portion of the fastener element 51 arranged at a side contacting the cloth 2, and the second leg portion 55 is a leg portion of the fastener element 51 arranged to be spaced from the cloth 2. Also, the first leg portion 54 and the second leg portion 55 respectively extend from end portions between which a bent portion of the engaging head is interposed. Further, the first leg portion 54 and the second leg portion 55 are configured to be symmetrical to each other.

The connecting string-shaped members 52 are respectively inserted into tip portions of the first leg portion 54 and second leg portion 55 of the fastener element 51. Further, opposing element inner surfaces of the first leg portion 54 and second leg portion 55 are respectively formed with inner side grooves 56, and element outer surfaces opposite to the element inner surfaces of the first leg portion 54 and second leg portion 55 are respectively formed with a first outer side groove 57*a* at the engaging head 53-side and a second outer side groove 57*b* at the tip portions-side (connecting string-shaped members 52-side) of the first and second leg portions 54, 55.

The connecting string-shaped members 52 connecting the plurality of fastener elements 51 have a first connecting string-shaped member 52*a* inserted into the tip portion (end portion opposite to the engaging head 53-side) of the first leg portion 54 and a second connecting string-shaped member 52*b* inserted into the tip portion of the second leg portion 55.

The first and second connecting string-shaped members 52*a*, 52*b* are made of the same synthetic resin as the fastener element 51 and penetrate the respective fastener elements 51. In the meantime, the first and second connecting string-shaped members 52*a*, 52*b* may consist of string-shaped members such as multi filament thread and the like. Also, the sectional shapes of the first and second connecting string-shaped members 52*a*, 52*b* can be arbitrarily changed, as required.

As described above, the element member 50 of the third illustrative embodiment is configured by injection molding the synthetic resin to the two connecting string-shaped members 52 arranged in parallel to form the plurality of fastener elements 51. At this time, the element member 50 just after the injection molding is formed with the first leg portion 54 and the second leg portion 55 of each fastener element 51 being straddled in the opposing directions.

In order to sew the element member 50 to the cloth 2, the first leg portion 54 of the fastener element 51 is first arranged on the back surface (first surface) of the cloth 2 with the first leg portion 54 and second leg portion 55 of the fastener element 51 being straddled and then the first sewing process is performed using the sewing machine, so that the first leg portion 54 is sewn to the cloth 2 by the double chain stitch of the first sewing thread 59*a*.

At this time, the looper thread of the first sewing thread 59*a* configuring the double chain stitch is accommodated in the inner side groove 56 of the first leg portion 54 of the fastener element 51, and the cloth 2 and the first leg portion 54 of the fastener element 51 are restrained between the looper thread of the first sewing thread 59*a* and the needle thread, so that the first leg portion 54 is sewn and fixed to the cloth 2. In this case, the cloth 2 and the fastener element 51 are sewn with the position of the fastener element 51 being conformed to the cloth 2 so that the engaging head 53 of the fastener element 51 protrudes from the side end edge of the cloth 2.

Subsequently, the second leg portion 55 of the fastener element 51 is rotated with respect to the first leg portion 54 of the fastener element 51 sewn to the cloth 2 about a central portion of the engaging head 53 so as to form a U-shaped section so that the inner surface of the first leg portion 54 and the inner surface of the second leg portion 55 face each other. Thereby, the first leg portion 54 and the second leg portion 55 are superimposed.

After that, the second sewing process is performed using the sewing machine, so that the superimposed first leg portion 54 and second leg portion 55 are sewn to the cloth 2 by the double chain stitch of the second sewing thread 59*b*. At this time, the looper thread of the second sewing thread 59*b* configuring the double chain stitch is accommodated in the second outer side groove 57*b* of the second leg portion 55 of the fastener element 51, and the cloth 2 and the first leg portion 54 and second leg portion 55 of the fastener element 51 are restrained between the looper thread of the second sewing thread 59*b* and the needle thread, so that the first leg portion 54 and the second leg portion 55 are sewn and fixed to the cloth 2.

In this way, the first and second sewing threads 59*a*, 59*b* are accommodated in the inner side groove 56 and second outer side groove 57*b* of the fastener element 51, and the fastener element 51 is sewn and fixed to the cloth 2 by the first and second sewing threads 59*a*, 59*b*, so that the fastener element 51 can be securely fixed to the cloth 2 without the positional deviation of the first and second sewing threads 59*a*, 59*b*.

When producing the garment with the slide fastener affixed thereto having the element member 50 of the third illustrative embodiment, the element member 50 and the cloth 2 for garment (cloth 2 before the cutting) are first prepared.

As described above, the element member 50 of the third illustrative embodiment can be produced by directly injection molding the synthetic resin to the first and second connecting string-shaped members 52*a*, 52*b* arranged in parallel and forming the plurality of fastener elements 51 having a predetermined shape at a state where the first leg portion 54 and second leg portion 55 of each fastener element are straddled about the engaging head 53. Also, the cloth 2 for garment becoming the fastener-attached member is produced by the knitting or weaving separately from the element member 50.

Then, the constitutional part for garment having the element member 50 attached thereto is produced using the element member 50 and cloth 2 produced as described above. Specifically, the element member 50 of which the first leg portion 54 and second leg portion 55 of the fastener element 51 are straddled is sewn to the placket of the cloth 2 configuring the front body of the garment by performing the two-step sewing processes of the first sewing process and the second sewing process. Thereby, the cloth 2 with the element member 50 affixed thereto is obtained.

Subsequently, the obtained cloth 2 with the element member 50 affixed thereto is cut out to have a predetermined shape corresponding to the front body of the garment. Thereby, the constitutional part for front body having the element member 50 attached thereto is produced.

At this time, the cutting is performed so that the element member 50 sewn to the cloth 2 is cut at the position of the connecting string-shaped members 52, not the position of the fastener element 51 of the element member 50.

After that, the produced constitutional parts of the respective regions are connected to assemble a garment by the sewing and the like. Also, the slider is slidably attached to the element rows of the element members 50 sewn to the cloth 2. Thereby, the garment with the slide fastener affixed thereto of the third illustrative embodiment is produced.

According to the garment with the slide fastener affixed thereto of the third illustrative embodiment, a part of the garment cloth 2 not only configures the garment but also functions as the fastener tape to configure the slide fastener. For this reason, the fastener tape that is necessarily provided in the related art is not required any more, so that it is possible to reduce the producing cost of the garment with the slide fastener affixed thereto. Also, it is possible to reduce the weight of the garment with the slide fastener affixed thereto and to improve the flexibility.

Also in the third illustrative embodiment, since it is possible to directly sew the element members 50 to the cloth 2 after imparting the desired function such as waterproofness and water repellency to the cloth 2, for example, it is possible to easily produce the garment with the high-quality slide fastener affixed thereto having the waterproofness, water repellency and the like.

Also in the third illustrative embodiment, when producing the constitutional part (for example, constitutional part for front body), for example, a method of, before the element member 50 is sewn to the cloth 2, cutting out the cloth 2 into a predetermined shape, cutting the element member 50 to have a predetermined length size (length size actually required) separately from the cloth 2, and then attaching the element member 50 having the predetermined length to the cut cloth 2 by the sewing may be used, in addition to the method described in the first illustrative embodiment.

Also, in the first to third illustrative embodiments, the garment has been described in which the slide fastener is used in a usual front use aspect (first illustrative embodiment) or in a reverse use aspect (second and third illustrative embodiments). However, the garment with the slide fastener affixed thereto of the present invention also includes a garment with a slide fastener affixed thereto in which right and left end edge portions of the opening and closing part of the garment are folded back into a U shape to form folded back portions, the element members are sewn to the right and left folded back portions by the sewing threads and the element members are thus directly attached to the cloth in a so-called concealed slide fastener aspect.

Even when element members are sewn to the cloth in the concealed slide fastener aspect, it is not necessary to separately use the fastener tape from the cloth becoming the fastener-attached member, so that it is possible to reduce the producing cost. Also, it is possible to reduce the weight of the garment with the concealed slide fastener affixed thereto and to improve the flexibility of the garment.

DESCRIPTION OF REFERENCE NUMERALS

1: Garment With Slide Fastener Affixed Thereto
2: Cloth (Fastener-Attached Member)
3: Cloth Piece
4: Element Row
5: Constitutional Part
6: Cloth Piece
7: Constitutional Part
10: Element Member
11: Fastener Element (Single Element)
12: Connecting String-Shaped Member
12*a*: First Connecting String-Shaped Member
12*b*: Second Connecting String-Shaped Member
13: Body Portion
14: Extension Portion
14*a*: First Extension Portion
14*b*: Second Extension Portion
15: Accommodation Groove
16: Curved Portion
17: Neck Portion
18: Engaging Head
19: Sewing Thread
20: Slider
21: Slider Body
22: Pull Tap
23: Upper Blade
24: Lower Blade
25: Upper Flange Portion
26: Ridge Portion
27: Pull Tap Attachment Portion
30: Slider
31: Slider Body
33: Upper Blade
34: Lower Blade
35: Lower Flange Portion
36: Ridge Portion
41: Reinforcement Sheet Member
42: Waterproof Layer
50: Element Member
51: Fastener Element (Single Member)
52: Connecting String-Shaped Member
52*a*: First Connecting String-Shaped Member
52*b*: Second Connecting String-Shaped Member
53: Engaging Head
54: First Leg Portion
55: Second Leg Portion
56: Inner Side Groove
57*a*: First Outer Side Groove
57*b*: Second Outer Side Groove
59*a*: First Sewing Thread
59*b*: Second Sewing Thread

The invention claimed is:

1. An article with a slide fastener affixed thereto comprising:

a pair of element members each of which has a plurality of single elements made of a synthetic resin and fixedly integrated and connected to at least one flexible connecting string-shaped member at an equal interval;

a slider formed with an element guide path between upper and lower blades; and a fastener-attached member forming an opening and closing part of the article, wherein the pair of element members are directly sewn to a first surface of the fastener-attached member by sewing threads, wherein the element members and the fastener-attached member are inserted into the element guide path of the slider, wherein a reinforcement sheet member is attached to the fastener-attached member, and wherein the element members are sewn to the fastener-attached member by the sewing threads together with the reinforcement sheet member.

2. The article with a slide fastener affixed thereto, according to claim 1, wherein each element member is configured by injection molding the plurality of single elements to the two connecting string-shaped members, wherein each of the single elements has a body portion into which the connecting string-shaped members are inserted and an extension portion extending from the body portion outside of the fastener-attached member, and wherein the extension portion has: a first extension portion which is arranged on a first surface-side which is at the fastener-attached member side and has a neck portion and an engaging head; and a second extension portion which is arranged on a second surface-side spaced from the fastener-attached member and has a triangular shape in which a size thereof in a tape length direction gradually decreases towards an extending direction.

3. The article with a slide fastener affixed thereto, according to claim 1, wherein each element member is configured by injection molding the plurality of single elements to the two connecting string-shaped members, wherein each of the single elements has an engaging head and a first leg portion and a second leg portion extending so as to interpose the engaging head therebetween, and wherein the connecting string-shaped members are respectively inserted into the first leg portion and second leg portion.

4. The article with a slide fastener affixed thereto, according to claim 1, wherein the reinforcement sheet member is provided between the element members and the fastener-attached member.

5. The article with a slide fastener affixed thereto, according to claim 1, wherein waterproof layers made of a synthetic resin are formed or resin film members are bonded on a second surface-side of the fastener-attached member, and wherein when the pair of element members are engaged, the opposing waterproof layers or resin film members are contacted to each other.

6. The article with a slide fastener affixed thereto, according to claim 1, wherein a cloth piece separate from the fastener-attached member is attached, as an end stop of the slider, adjacent to at least one of one end portion and the other end portion of an element row formed by the plurality of single elements.

7. A method of producing an article with a slide fastener affixed thereto, the slide fastener being configured to open and close by sliding of a slider and being attached to a fastener-attached member, the method comprising:

preparing a pair of element members having a plurality of engaging heads arranged at an equal interval;

fixing a reinforcement sheet member to the fastener-attached member;

preparing a constitutional part having the element members by sewing the element members to a first surface-side of the fastener-attached member together with the reinforcement sheet member by sewing threads and cutting out the fastener-attached member having the element members sewn thereto into a predetermined shape together with the element members or by cutting out the fastener-attached member into a predetermined shape, cutting the element members to have a predetermined length and sewing the element members to the first surface-side of the fastener-attached member together with the reinforcement sheet member by sewing threads, and assembling the article by using the constitutional part and slidably attaching the slider to an element row configured by the element members.

8. The method according to claim 7, further comprising attaching a cloth piece separate from the fastener-attached member, as an end stop of the slider, adjacent to at least one of one end portion and the other end portion of the element row of the constitutional part.

9. The method according to claim 7, further comprising preparing each of the element members by injection molding a plurality of single elements having the engaging heads to at least one flexible connecting string-shaped member.

10. The method according to claim 7, further comprising cutting the element members at a part of the connecting string-shaped member upon the cutting out of the fastener-attached member or upon the cutting of the element members.

11. The method according to claim 7, wherein the reinforcement sheet member is provided between the element members and the fastener-attached member.

12. The method according to claim 7, further comprising, after sewing the element members to the fastener-attached member, forming waterproof layers made of a synthetic resin on a second surface-side of the fastener-attached member so that the opposing waterproof layers are contacted to each other when the element members are engaged or bonding resin film members on the second surface-side of the fastener-attached member so that the opposing resin film members are contacted to each other when the element members are engaged.

13. The method according to claim 7, further comprising producing a garment serving as the article with the slide fastener affixed thereto by using the constitutional part for a region in which an opening and closing part of a front body or rear body of the garment is formed.

* * * * *